US005689280A

United States Patent [19]

Asari et al.

[11] Patent Number: 5,689,280

[45] Date of Patent: Nov. 18, 1997

[54] DISPLAY APPARATUS AND A DRIVING METHOD FOR A DISPLAY APPARATUS

[75] Inventors: Goro Asari, Yokohama; Yutaka Nakagawa, Isehara, both of Japan; Temkar N. Ruckmongathan, Bengalore, India; Takeshi Kuwata, Yokohama, Japan

[73] Assignee: Asahi Glass Company Ltd., Tokyo, Japan

[21] Appl. No.: 714,493

[22] Filed: Sep. 16, 1996

Related U.S. Application Data

[63] Continuation of Ser. No. 219,926, Mar. 30, 1994, abandoned.

[30] Foreign Application Priority Data

Mar. 30, 1993 [JP] Japan ..... 5-095575
Jul. 23, 1993 [JP] Japan ..... 5-202926

[51] Int. Cl.[6] ..... G09G 3/36

[52] U.S. Cl. ..... 345/89; 345/95; 345/100

[58] Field of Search ..... 345/84, 87, 88, 345/89, 94, 95, 96, 97, 98, 99, 100, 208, 147–148, 152, 204, 200, 211, 212; 349/33, 34, 36, 39

[56] References Cited

U.S. PATENT DOCUMENTS

| | | | |
|---|---|---|---|
| 4,769,713 | 9/1988 | Yasui | 345/89 |
| 5,089,812 | 2/1992 | Fuse et al. . | |
| 5,189,406 | 2/1993 | Humphries et al. | 345/97 |
| 5,250,937 | 10/1993 | Kikuo et al. | 345/94 |
| 5,459,495 | 10/1995 | Scheffer | 345/147 |

FOREIGN PATENT DOCUMENTS

| | | |
|---|---|---|
| 0 319 291 | 6/1989 | European Pat. Off. . |
| 0 507 061 | 10/1992 | European Pat. Off. . |
| 0 569 974 | 11/1993 | European Pat. Off. . |

OTHER PUBLICATIONS

Scheffer et al, "Active Addressing™ of STN displays for high–performance video applications," Display, v. 14, No. 2, Apr. 1993.

(List continued on next page.)

*Primary Examiner*—Steven Saras
*Attorney, Agent, or Firm*—Oblon, Spivak, McClelland, Maier & Neustadt, P.C.

[57] ABSTRACT

A display apparatus in which the light transmittance of a pixel selected by a scanning electrode and a data electrode is changed in correspondence with a difference of voltages applied to the scanning electrode and the data electrode has a display panel having a plurality of scanning electrodes and a plurality of data electrodes, a signified video signal forming device for forming signified video signals by distributing digital video signals in a picture to subpictures having the same number as bits each having a bit significance; an orthogonal function generator for generating orthogonal function signals having substantial orthogonality; an orthogonal transformation signal generator for receiving the signified video signals and the orthogonal function signals to operate and output data signals; a scanning voltage generator for receiving scanning signals to apply scanning voltages to the scanning electrodes of the display panel; and a data voltage generator for receiving data signals to apply data voltages to the data electrodes of the display panel, wherein the scanning voltage generator and the data voltage generator are such ones that the peak value of a driving voltage, in each of the subpictures, applied to the display panel as a voltage difference between the scanning voltage and the data voltage corresponds to a significance value of a bit of the digital video signals.

12 Claims, 15 Drawing Sheets

OTHER PUBLICATIONS

"Some New Addressing Techniques for RMS Responding Matrix LCD's" by T.N. Ruckmongathan. Thesis Submitted for the Degree of Doctor Philosophy, Dept. of Electrical Communication Engineering Indian Institute of Science, Feb. 1988.

"New Addressing Techniques for Multiplexed Liquid Crystal Displays", by T.N. Ruckmongathan and N.V. Madhusudana, Proceedings of the SID, v. 24/3, 1983.

1988 Int'l Display Research Conference, "A Generalized Addresssing Technique for RMS Responding Matrix LCDS", by T.N. Ruckmongathan, pp. 80–85.

DISPLAY APPARATUS AND A DRIVING METHOD FOR A DISPLAY APPARATUS

This application is a Continuation of application Ser. No. 08/219,926, filed on Mar. 30, 1994 now abandoned.

BACKGROUND OF THE INVENTION

1. Field of the Invention

The present invention relates to a matrix type display apparatus, i.e. a passive matrix type display apparatus to be driven by simultaneously selecting a plurality of row electrodes and using signals transformed by an orthogonal function. In particular, the present invention relates to a display apparatus showing a change of the light transmittance when a voltage applied to the intersection of a lateral electrode and a longitudinal electrode arranged in a matrix form, i.e. a row electrode and a column electrode, exceeds a threshold value.

2. Discussion of the background

A conventional technique will be described by taking a liquid crystal display apparatus as an example. A data electrode is referred to as a column electrode and a scanning electrode is referred to as a row electrode. There have been known the following systems in driving a passive matrix type liquid crystal display panel comprising an $N_r$ number of row electrodes and an $M_c$ number of column electrodes. One of the systems is a so-called successive line scanning method wherein a group of pixel signals corresponding to pixels on an arbitrary line of row electrodes are applied to column electrodes, and at the same time, row electrode selection voltages are applied to the row electrodes to thereby select pixels, and the light transmittance of each of the pixels selected is changed; and the above-mentioned operation is effected to scan the $N_r$ number of row electrodes for each of the electrodes. The other system is known as a multi-line selection and driving system wherein a plurality of row electrodes are simultaneously selected by using an orthogonal transformation and composite signals corresponding to the selected electrodes, which are subjected to orthogonal transformation, are applied to column electrodes.

In the liquid crystal display apparatus, the light transmittance of a pixel has a threshold characteristic which relies on the effective value of a voltage applied to the pixel. In the above-mentioned driving method, it has been known that the condition to obtain the ratio of the maximum and minimum values of light transmittance, i.e. the largest contrast ratio, can be expressed by formula (1) (reference document: Scanning Limitations of Liquid-Crystal-Displays, IEEE Transactions on Electron Devices, vol. ED-21, No. 2, February 1974, pp146–155 by Paul M. Alt, Peter Pleshko):

$$V_r/V_c=N_r^{1/2} \quad (1)$$

Under the condition of the formula (1), the ratio of the effective value $V_{on}$ of a pixel voltage which provides the maximum (or the minimum) light transmittance to the effective value $V_{off}$ of the pixel voltage which provides the minimum (or the maximum) transmittance is expressed by formula (2).

$$V_{on}/V_{off}=((N_r^{1/2}-1)/(N^{1/2}+1))^{1/2} \quad (2)$$

Further, $V_{off}$ is given by formula (3).

$$V_{off}=V_c(2(N_r-N_r^{1/2})/N_r^2)^{1/2} \quad (3)$$

From the formulas (1) and (3), formula (4) is obtained.

$$V_r=V_{off}[N_r/(2(1-1/N_r^{1/2}))]^{1/2}=V_{th}[N_r/(2(1-1/N_r^{1/2}))]^{1/2} \quad (4)$$

The value $V_{off}$ is generally set to a threshold value $V_{th}$ of transmittance vs effective value characteristics. Accordingly, the values $V_c$ and $V_r$ are determined by the value of $V_{th}$. Therefore, the conventional technique had a drawback that as the number of row electrodes was increased, a very higher value was required for the row voltage. In the passive matrix display apparatus, a gray shade display could be obtained by an amplitude modulation wherein a column voltage is changed depending on a degree of gray shade, or by changing a voltage application time in a case that a voltage applied to row electrodes is fixed to $+V_r$ or $-V_r$ in a selection time, and the voltage is $0_v$ in a non-selection time. As a method for changing the application time, there are a method of changing the pulse width of a column voltage (pulse width modulation) and a method of changing the number of pulses while the pulse width is constant (pulse number modulation). To effect the pulse number modulation, for instance, one picture may be expressed by the number of frames (or the number of fields) corresponding to the number of gray shade levels, and the number of $V_{on}$ is controlled depending on the gray shade of each of the pixels. Such a method is called frame modulation.

In the amplitude modulation, if it is used without any correction, the effective value, i.e. the root mean square value of a voltage applied to a column electrode varies from that to another column electrode or a frame, this causing non-uniformity of display. Accordingly, a correction signal is needed, and, as a result, a signal processing circuit becomes complicated.

In the pulse width modulation, non-uniformity of a display may be caused because distortion in the waveform of a voltage becomes large for a pixel remote from a driving point due to an electrode resistance when a signal having a narrow pulse width is applied. When the pulse width is sufficiently widened in the pulse width modulation, the frame frequency becomes too small so that a flicker is resulted in a picture. The frame modulation has a problem that a low frequency driving signal component increases as the number of gray shade levels is increased and a flicker becomes conspicuous, unless the frame frequency can not be increased.

Japanese Unexamined Patent Publication No. 8910/1978 proposes a gray shade display method for reducing a flicker. In the publication, a successive line scanning and driving system is used in which n fields are determined in one excitation period and periodically scanning is effected for excitation; analog data signals are changed into binary signals of n bits; the binary signals are selected and outputted in correspondence with each field of the n fields; one of significance values $2^0, 2^1, 2^2, \ldots 2^{n-1}$ is applied to each field of the n fields, and an element in a X-Y matrix structure is excited on the basis of a bit output selected and weighted for each field.

However, it is not easy to employ such a system on the multi-line selection and driving method wherein a plurality of row electrodes are simultaneously selected by using an orthogonal transformation and plural lines of composite signals which have been subjected to an orthogonal transformation are applied to column electrodes.

SUMMARY OF THE INVENTION

According to the present invention, there is provided a display apparatus in which the light transmittance of a pixel selected by a scanning electrode and a data electrode is changed in correspondence with a difference of voltages applied to the scanning electrode and the data electrode, characterized by comprising:

a display panel having a plurality of scanning electrodes and a plurality of data electrodes, a signified video signal forming device for forming signified video signals by distributing digital video signals in a picture to subpictures having the same number as bits each having a bit significance;

an orthogonal function generator for generating orthogonal function signals having substantial orthogonality;

an orthogonal transformation signal generator for receiving the signified video signals and the orthogonal function signals to operate and output data signals;

a scanning voltage generator for receiving scanning signals to apply scanning voltages to the scanning electrodes of the display panel; and a data voltage generator for receiving data signals to apply data voltages to the data electrodes of the display panel, wherein the scanning voltage generator and the data voltage generator are such ones that the peak value of a driving voltage, in each of the subpictures, applied to the display panel as a voltage difference between the scanning voltage and the data voltage corresponds to a significance value of a bit of the digital video signals.

In a preferred embodiment of the present invention, the signified video signal forming device comprises a field counter for outputting subpicture numbers, and a frame memory for receiving the digital video signals and the subpicture numbers to output signified video signals.

Further, in the present invention, the display apparatus comprises a non-selection voltage generator which receives a subpicture number to form a non-selection voltage so that the effective value of a driving voltage corresponding to a low level in a subpicture agrees with a predetermined voltage in spite of a significance value of a bit.

In a preferred embodiment of the present invention, the predetermined voltage is such a voltage that the light transmittance is substantially a minimum on the voltage-light transmittance characteristic curve of the display panel.

Further, in the present invention, there is provided a driving method for a display apparatus in which the light transmittance of a pixel selected by a scanning electrode and a data electrode in correspondence with a difference of voltages applied to the scanning electrode and the data electrode, and a data electrode signal applied to the data electrode is an orthogonal transformation signal obtained by orthogonal transformation of a video signal corresponding to the position of a scanning electrode selected in a display panel, and a scanning electrode signal applied to the selected scanning electrode is the orthogonal signal, characterized in that digital video signals in a picture are distributed to subpictures having the same number of bits each having a significance value, and the peak value of a driving voltage in each of the subpictures is made correspondence with the significance value of the bits.

In a preferred embodiment of the driving method, voltages applied to the scanning electrode and the data electrode are simultaneously changed with a constant rate in correspondence with bit significance values corresponding to each of the subpictures.

In another preferred embodiment of the present invention, a reference voltage applied to either the data electrode or the scanning electrode is changed depending on a bit significance of each of the subpictures.

Further, there is provided the driving method wherein, the effective value of a driving voltage corresponding to a low level in a subpicture agrees with a predetermined voltage independent of a bit significance.

In a preferred embodiment of the driving method of the present invention, the predetermined voltage is such a voltage that the light transmittance is substantially a minimum on the voltage-light transmittance characteristic curve of the display panel.

Further, in a preferred embodiment of the driving method of the present invention, a scanning voltage and a data voltage are produced from a common reference voltage source so as to maintain a condition that the ratio of the peak value of the scanning voltage to the peak value of the data voltage is constant; the scanning voltage and the data voltage are changed with the same rate depending on the significance values of bits corresponding to each of the subpictures; and a predetermined bias voltage is applied to a scanning electrode in a non-selection state, whereby a desired gray shade level is obtained.

DESCRIPTION OF THE PREFERRED EMBODIMETNS

Preferred embodiments of the present invention will be described

In the present invention, a plurality of row electrodes are simultaneously selected. When the successive line scanning method is used, the present invention can be applied by using "1" as an orthogonal function. Hereinbelow, description will be made on the premise that a plurality of row electrodes are simultaneously selected.

In a conventional technique, the peak value of a driving voltage became inadvantageously large to maintain the effective value of the driving voltage to be a predetermined level or higher when there are a large number of row electrodes. In the present invention, however, the driving voltage can be reduced by simultaneously selecting a plurality of row electrodes and combining video signals transformed by an orthogonal function and the video signals of the inverse conversion. An example of reducing the driving voltage which was proposed before will be explained with reference to FIG. 2.

Figure 2:
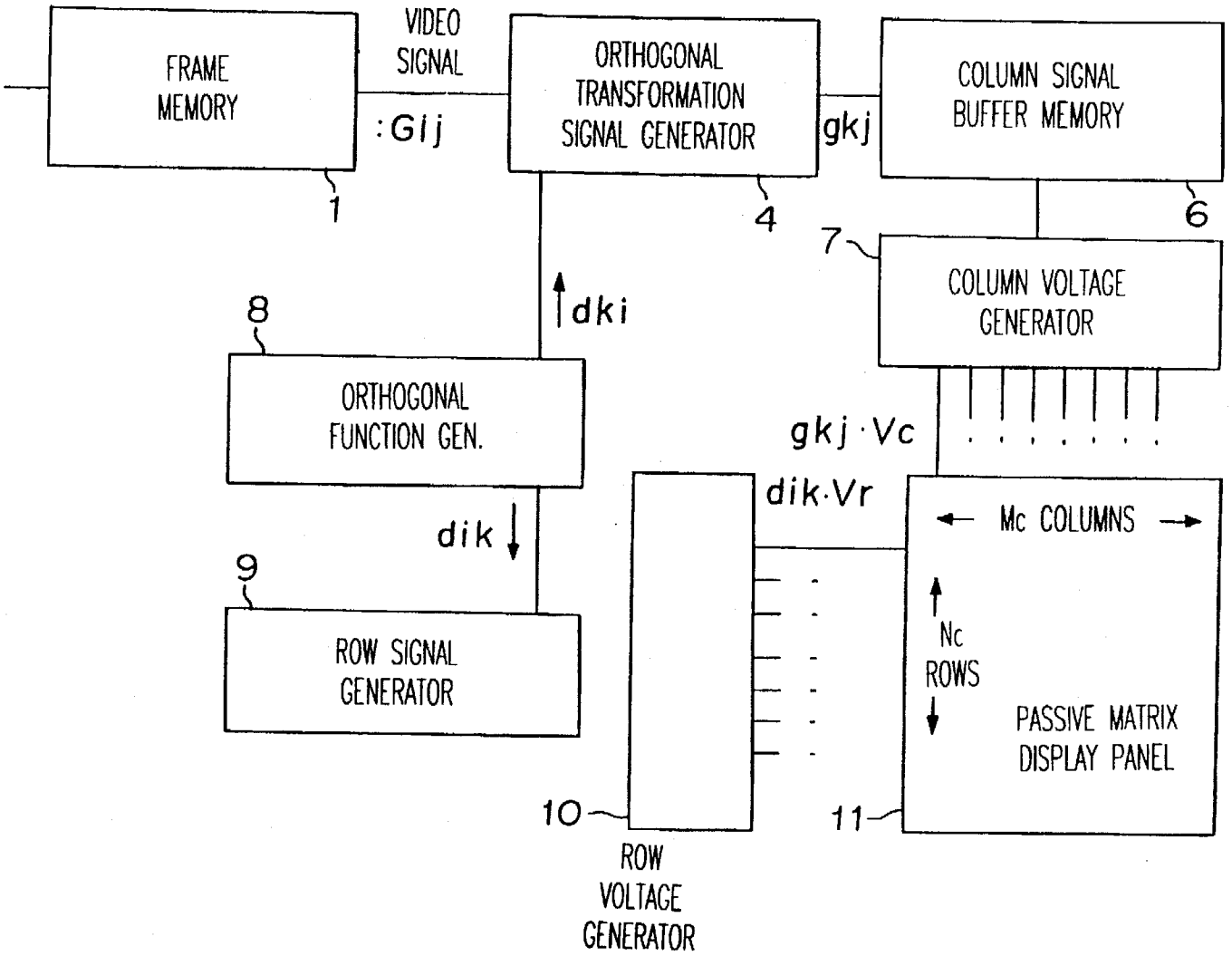
FIG. 2 is a block diagram for explaining an example proposed before.

FIG. 2 shows a treatment of signals after video signals have been transformed into digital signals. The video signals are once stored in a frame memory 1, and then, are subjected to signal transformation, preferably, by a regular orthogonal function system, on signals of an L number of horizontal lines which correspond to an arbitrarily selected L number of row electrodes (row number=i, i=1–L) in a display panel 11. By the signal transformation, orthogonal transformation signals $g_{kj}$ are obtainable. Namely, when the video signal (gray shade signal) of a pixel (i, j) corresponding to a row number i (i=1–L) and a column number j (j=1–$M_c$) is $G_{ij}$, and a signal from an orthogonal function generator 8 is expressed by a matrix $[d_{ki}]$, an orthogonal transformation signal can be expressed by formula (5):

$$g_{kj}(\Delta t_k)=\Sigma d_{ki}G_{ij}\{k=1-L,\ i=1-L\} \tag{5}$$

where k is a suffix relating to time and it assumes a value from 1 through L.

A relation of $(\Delta t_k)$ to a time $\Delta t_s$ in which a group of row electrodes [i (i=1–L)] is selected is expressed by formula (6):

$$\sum_{k=1}^{L}\{\Delta t_k\}=\Delta t_s \tag{6}$$

where $$\sum_{k=1}^{L}\{\ \}$$

expresses the sum of k=1 through L in { }.

The definition is applicable to the description mentioned below. i indicates the number of the row electrodes described above. An L number of pixels on a j column which are considered to be a single group are developed as an L number of signals on the time axis. Hereinbelow, $g_{kj}$ indicates $g_{kj}(\Delta t_k)$ unless specifically mentioned. When a Walsh function system is used to obtain an orthogonal function, for instance, $[d_{ki}]$ takes function values shown in Table 1.

TABLE 1

Orthogonal function $[d_{ki}]$ {k = 1–L, i = 1–L}
An example of a Walsh function A case of L = 2

| k \ i | 1 | 2 |
|---|---|---|
| 1 | +1 | +1 |
| 2 | +1 | −1 |

A case of L = 4

| k \ i | 1 | 2 | 3 | 4 |
|---|---|---|---|---|
| 1 | +1 | +1 | +1 | +1 |
| 2 | +1 | −1 | +1 | +1 |
| 3 | +1 | +1 | −1 | −1 |
| 4 | +1 | −1 | −1 | +1 |

A case of L = 8

| k \ i | 1 | 2 | 3 | 4 | 5 | 6 | 7 | 8 |
|---|---|---|---|---|---|---|---|---|
| 1 | +1 | +1 | +1 | +1 | +1 | +1 | +1 | +1 |
| 2 | +1 | −1 | +1 | +1 | +1 | −1 | +1 | +1 |
| 3 | +1 | +1 | −1 | −1 | +1 | +1 | −1 | −1 |
| 4 | +1 | −1 | −1 | +1 | +1 | −1 | −1 | +1 |
| 5 | +1 | +1 | +1 | +1 | −1 | −1 | −1 | −1 |
| 6 | +1 | −1 | +1 | +1 | −1 | +1 | −1 | −1 |
| 7 | +1 | +1 | −1 | −1 | −1 | −1 | +1 | +1 |
| 8 | +1 | −1 | −1 | +1 | −1 | +1 | +1 | −1 |

Hereinbelow, description will be made on the supposition that a degree L of orthogonal function is equal to the number of simultaneously selected row electrodes. When the degree L of the orthogonal function is not equal to the number of simultaneously selected row electrodes, the following description can be applied by adding an imaginary electrode (electrodes) to the row electrodes simultaneously selected.

A group of the video signals $G_{ij}$(i=1–L) having a column number of j and a row number of i is transformed into an L number of orthogonal transformation signals $g_{kj}$ (k=1–L) relating to j column electrodes, and the transformed orthogonal transformation signals are developed on the time axis.

When a display of signals corresponding to the original video signals is required on the display panel 11, the orthogonal transformation signals $g_{kj}$ can be converted inversely. The inverse conversion is expressed by formula (7):

$$[G_{ij}]=[d_{ki}]^{-1}[g'_{kj}] \tag{7}$$

Because $[d_{ki}]$ is an orthogonal function, $[d_{ki}]=[d_{ik}]$, formula (8) is obtainable.

$$\begin{aligned}[G_{ij}] &= (1/L)\,[d_{ik}]\,[g_{kj}] \\ &= (1/L)\sum_{k=1}^{L}\{d_{ik}g_{kj}\}\end{aligned} \tag{8}$$

In order to realize the inverse conversion, the orthogonal function $[d_{ik}]$ can be used as a driving signal for the row electrodes i (i=1–L) simultaneously selected. In this case, the light transmittance of liquid crystal depends on the effective value of an applied voltage, i.e. the root mean square value, and accordingly, the display signals contain the sum of products $$\sum_{k=1}^{L}\{d_{ik}g_{kj}\}$$

of the row signals ($d_{ik}$) and the column signals ($g_{kj}$), whereby restored signals corresponding to the original video signals can be obtained. The process will be described in more detail.

When the effective value of a voltage applied to a pixel (i, j) in a frame is $V_{ij}$, formulas (9) and (10) are respectively obtainable:

$$V_{ij}^2=\left[\sum_{k=1}^{L}\{(d_{ik}V_r-g_{kj}V_c)^2\}+\sum_{k=L+1}^{F}\{(g_{kj}V_c)^2\}\right]/F \tag{9}$$

$$F=L\cdot M \quad F\geqq N_r \tag{10}$$

In formula (10), M indicates a number of times for simultaneous selection required for scanning entirely the number $N_r$ of row electrodes in a case an L number of row electrodes are simultaneously selected at once. Namely, M indicates a number of times for simultaneous selection necessary for completing a frame. Accordingly, F is an integer greater than or equal to $N_r$.

Row electrode driving signals $d_{ik}$ are generated from an orthogonal function generator 8 and the signals are supplied to a row signal generator 9 whereby voltages ($d_{ik}V_r$) are generated from a row voltage generator 10 to be applied to row electrodes i. Orthogonal transformation signals $g_{kj}$ are generated from a column signal generator 6 to be supplied to a column voltage generator 7 from which voltages ($g_{kj}V_c$) are generated to be applied to column electrodes j.

The first term in formula (9) shows a time period in which the row electrodes are selected, and the second term corresponds to the mean square value of a non-selection time period. The row voltage in a non-selection time is 0, and the length of the time is expressed by formula (11):

$$L\cdot(M-1)\cdot(\Delta t_k) \tag{11}$$

By developing and arranging formula (9), formula (12) is obtainable:

$$V_{ij}^2=\left[\sum_{k=1}^{L}\{(d_{ik}V_r)^2\}+\sum_{u=1}^{F}\{(g_{uj}V_c)^2\}-2\sum_{k=1}^{L}\{(d_{ik}g_{kj})V_rV_c\}\right]/F \tag{12}$$

since $d_{ik}=\pm1$, the first term in formula (12) can be arranged as shown in Formula (13) wherein the first term is constant.

$$\sum_{k=1}^{L}\{(d_{ik}V_r)^2\}=LV_r^2 \tag{13}$$

From equation (8), it is clear that the third term in equation (12) is the inverse conversion of $g_{kj}$. By substituting formula (8) for the third term of formula (12), formula (14) is obtainable. Accordingly, the third term of formula (12) is constant.

$$2\sum_{k=1}^{L}\{(d_{ik}g_{kj})V_rV_c\}=2LG_{ij}V_rV_c \tag{14}$$

Accordingly, when the second term of formula (12) is kept constant, $V_{ij}$ and the video signal $G_{ij}$ have a one-to-one relation whereby the picture image can be restored.

Since the second term of formula (12) can be expressed by $$\sum_{u=1}^{F}\{(g_{uj}V_c)^2\}=\left[\sum_{l=L+1}^{F}\{(g_{lj})^2\}+\sum_{k=1}^{L}\{(g_{kj})^2\}\right]V_c^2,$$

a value $$\sum_{k}\{(g_{kj})^2\}$$

which is the net value of the squared sum of signals obtained by the orthogonal transformation of the video signals $G_{ij}$ is examined. By using the matrix [$d_{ki}$] as an orthogonal function, formula (15) is obtainable.

$$\sum_{k}\{(g_{kj})^2\}+\sum_{k}\left\{\left(\sum_{i}\{d_{ki}G_{ij}\}\right)^2\right\}=L\sum_{i}\{G_{ij}^2\} \tag{15}$$

In formula (15), in a case that $G_{ij}$ is composed of only two values, i.e., a case having only "bright" or "dark" and $G_{ij}\pm q$ (q is a constant value), formula (16) is obtainable:

$$\sum_{k}(g_{kj})^2=L^2q^2 \tag{16}$$

Accordingly, the second term in formula (12) is expressed as follows.

$$\sum_{p}^{F}(g_{pj}V_c)^2=FLq^2V_c^2 \tag{17}$$

Namely, when the video signals are binary signals, the second term of formula (12) is constant. On the other hand, when the video signals have an intermediate level other than the binary signals, the second term of formula (12) is not constant, and correction signals are required. By rewriting formula (12) with use of formulas (13), (14) and (17), the following formula is provided:

$$V_{ij}^2=[LV_r^2+FLq^2V_c^2-2LG_{ij}V_rV_c]/F$$

The above formula indicates that the effective voltage of a pixel directly corresponds to a video signal if the peak value $V_r$ of a row voltage and the peak value $V_c$ of a column voltage are constant.

Then, the maximum value and the minimum value of ($V_{ij}^2$) are obtained for the purpose of comparing formula (3) obtained from formula (1) which is described on the conventional system. Since the first and second terms in the above-rewritten formula are constant, the third term is the factor to determine the maximum value or the minimum value. Since $G_{ij}=\pm q$, (q is a constant), the minimum value: $(V_{ij}^2)_{MIN}$ and the maximum value: $(V_{ij}^2)_{MAX}$ are respectively expressed by formula (18) and (19).

$$(V_{ij}^2)_{MIN}=L[V_r^2+Fq^2V_c^2-2qV_rV_c]/F \tag{18}$$

$$(V_{ij}^2)_{MAX}=L[V_r^2+Fq^2V_c^2+2qV_rV_c]/F \tag{19}$$

The ratio of the maximum to the minimum value, i.e. the selection ratio of ($V_{ij}^2$) is obtained. The selection ratio has the same meaning as the ON/OFF explained with reference to formula (2). When the selection ratio is expressed by (SR), formula (20) is provided.

$$(SR)^2=[V_r^2+Fq^2V_c^2+2q|V_rV_c|]/[V_r^2+Fq^2V_c^2-2q|V_rV_c|] \tag{20}$$

The maximum value of formula (20) can be obtained when ($V_r^2+Fq^2V_c^2$) takes the minimum value. Namely, formula (21) is established.

$$V_r^2=Fq^2V_c^2 \quad (21)$$

By putting formula (21) into formula (20) and arranging it, formula (22) is obtainable.

$$(SR)^2_{MAX}=(F^{1/2}+1)/(F^{1/2}-1) \quad (22)$$

Under the condition of formula (21), the minimum value of a pixel voltage is expressed by formula (23) by using formula (19).

$$\begin{aligned}(V_{ij}^2)_{MIN} &= L[V_r^2+Fq^2V_c^2-2q|V_rV_c|]/F \\ &= 2L[l-1/F^{1/2})]V_r^2/F\end{aligned} \quad (23)$$

When the minimum value is set to the threshold voltage $V_{th}$, formula (24) is obtainable since F=ML.

$$V_r=V_{th}[M/(2(1-1/(F^{1/2}))]^{1/2} \quad (24)$$

In comparing formula (24) with formula (4), the following formulas are obtained. $N_r^{1/2}>>1$, and $F^{1/2}>>1$ in a case that there are many row electrodes. Accordingly, the peak value of the row voltage shown in formula (24) is reduced by a factor of $(M/N_r)^{1/2}$. As in formula (21), the ratio of the row electrode driving peak voltage $V_r$ to the column electrode driving peak voltage $V_c$ is $(F^{1/2}q)$. Since this figure is usually larger than 1, $V_r>V_c$. Further, F=LM, which is a figure close to $N_r$. Accordingly, the ON/OFF ratio, i.e., the selection ratio (formula (22)) assumes substantially the same value as that of formula (2) showing the ON/OFF ratio in the conventional technique.

In the following, description will be made as to the relation of the number of row electrodes simultaneously selected and the degree number L of the Walsh function.

The above-mentioned description concerns a case of S=L wherein S is the number of row electrodes simultaneously selected. However, in a case of S≠L, it is necessary to select the Walsh function so as to be L>S. In this case, the number of times M of simultaneous selection is the smallest integer providing $M\cdot S>N_r$, and a time per frame is $F=L\cdot M\cdot \Delta t_k$ which is longer than a case that S is equal to L, and the selection ratio is also small.

As described above, the driving voltage can be reduced by the simultaneous selection of a plurality of the row electrodes and the transformation of signals by an orthogonal function.

In the present invention, during a selection time, an L number of signals developed on the time axis are applied to row electrodes as shown in formula (5). When a liquid crystal display element is driven, the L number of signals are dispersed in one frame and applied to row electrodes whereby a relaxation phenomenon of liquid crystal can be suppressed. The relaxation phenomenon of liquid crystal is seen in a liquid crystal display element having a large number of scanning lines or a liquid crystal display element using a fast responding liquid crystal having a response time of about 50–100 ms, that the response of liquid crystal is out of the response to effective value of an applied voltage, the reduction of contrast ratio is resulted. The reduction of the contrast ratio of a liquid crystal display element can be suppressed by dispersing the L number of signals in one frame and applying the signals. As a method of dispersion and application of the signals, a method described in U.S. Pat. No. 5,262,881 can be employed.

In the following, a relation of the video signals to the column driving signals will be described.

Formula (25) can be obtained from formula (16) and function values shown in Table 1.

$$(g_k)_{MAX}=Lq \quad (25)$$

The formula (25) indicates that the scale factor between the video signals and the driving signals is L. Accordingly, the number of gray shade levels of the column electrode driving signals should have an L number of levels in a binary (bright and dark) display. The following is description concerning a method of gray scale display using subpictures with only two values. A gray shade display can be realized by using the residual image characteristics of visual sensation. For instance, it can be obtained by superposing a picture expressed by two bright and dark values on a time axis. As a method proposed, one frame is divided into subpictures (field pictures) whose number is smaller than the number of gray shades by 1, and "bright" and "dark" are distributed for display in response to the gray shade level in each picture element. According to this method, however, a flicker is apt to take place as the number of gray shade levels increases because the number of fields is smaller than the number of gray shades only by 1. On the other hand, according to the present invention, the number of fields can be reduced by applying significance values to the degrees of brightness of a "bright" portion in each field. Namely, one field is used for each bit of the video signals to adjust the peak value of the column electrode driving voltage depending on the significance values of bits. In the conventional technique, a video signal composed of N bits requires (2N–1) fields. However, according to the present invention, an N number of fields is sufficient. The peak value of the column voltage can be determined by the method described as follows.

Figure 12:
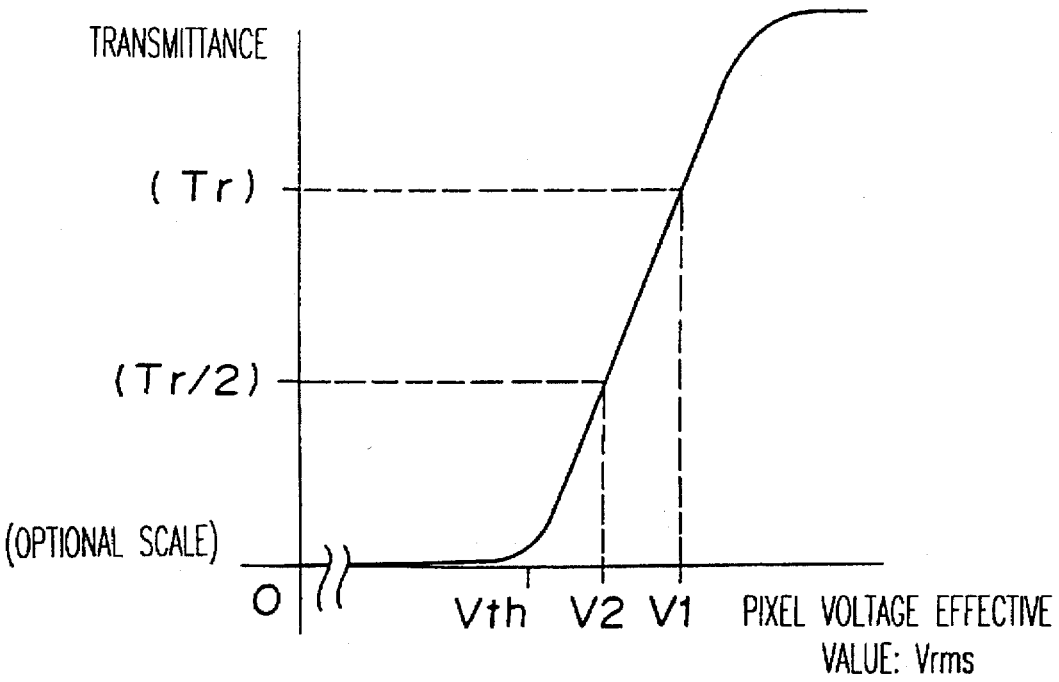
FIG. 12 is a graph showing a relation of the light transmittance to the effective value of a voltage applied to a pixel.

As described before, the liquid crystal display element is responsive to the effective value of a pixel voltage. In considering a liquid crystal panel having a relation of the light transmittance to the effective value of a pixel voltage as shown in FIG. 12, there is provided formula (26) wherein a video signal for a pixel (i, j) is formed of a binary code having an N bit length.

$$G_{ij}=\{d1_{ij}, d2_{ij}, d3_{ij}, \ldots, dN_{ij}\} \quad (26)$$

where a figure having a smaller suffix number indicates a bit having a larger significance.

First, driving voltages $V_r$ and $V_c$ are determined so as to satisfy formulas (21)–(24) with respect to the most significant field ($d1_{ij}$). In this case, $V_{th}$ in formula (24) is the same as the threshold value as shown in FIG. 12, and $V_1$ in FIG. 12 corresponds to ($V_{ijMAX}$) in formula (19). Since the significance value of ($d2_{ij}$) is one half as ($d1_{ij}$), a pixel voltage effective value $V_2$ which is half in the light transmittance of $V_1$ is obtained from the characteristic curve of FIG. 12. Then, a requisite column voltage peak value ($V_{c2}$) is obtained from $V_2$ and formula (19). $V_2$ can be expressed as formula (27).

$$V_2^2=L[V_r^2+Fq^2V_{c2}^2+2qV_rV_c^2]/F \quad (27)$$

By arranging formula (27), $V_{c2}$ is expressed as in formula (28).

$$V_{c2}=V_{th}[(V_2/V_{th})^2-0.5)^{1/2}-(1/(2(F-F^{1/2}))^{1/2}]/(L^{1/2})q) \quad (28)$$

In the same manner as above, column voltage peak values corresponding to bits of ($d3_{ij}$) or lower can be determined. The method of the present invention is more advantageous than a simple frame modulation from the viewpoint of contrast because the pixel voltage effective value in a dark time in a field corresponding to ($d2_{ij}$) or lower is smaller than $V_{th}$. In FIG. 12, a point corresponding to a value of 1/2N of the transmittance Tr corresponding to the most significant bit (MSB) in response to the bit significance. Then, a point in which the working point is smaller than $V_{th}$ can be finally obtained since the transmittance is not zero at the point of the threshold value $V_{th}$ as clearly shown in FIG. 12. In this case, when ON and OFF voltages are determined and a contrast ratio measured is larger than 1, a gray shade display is obtainable.

Figure 1:
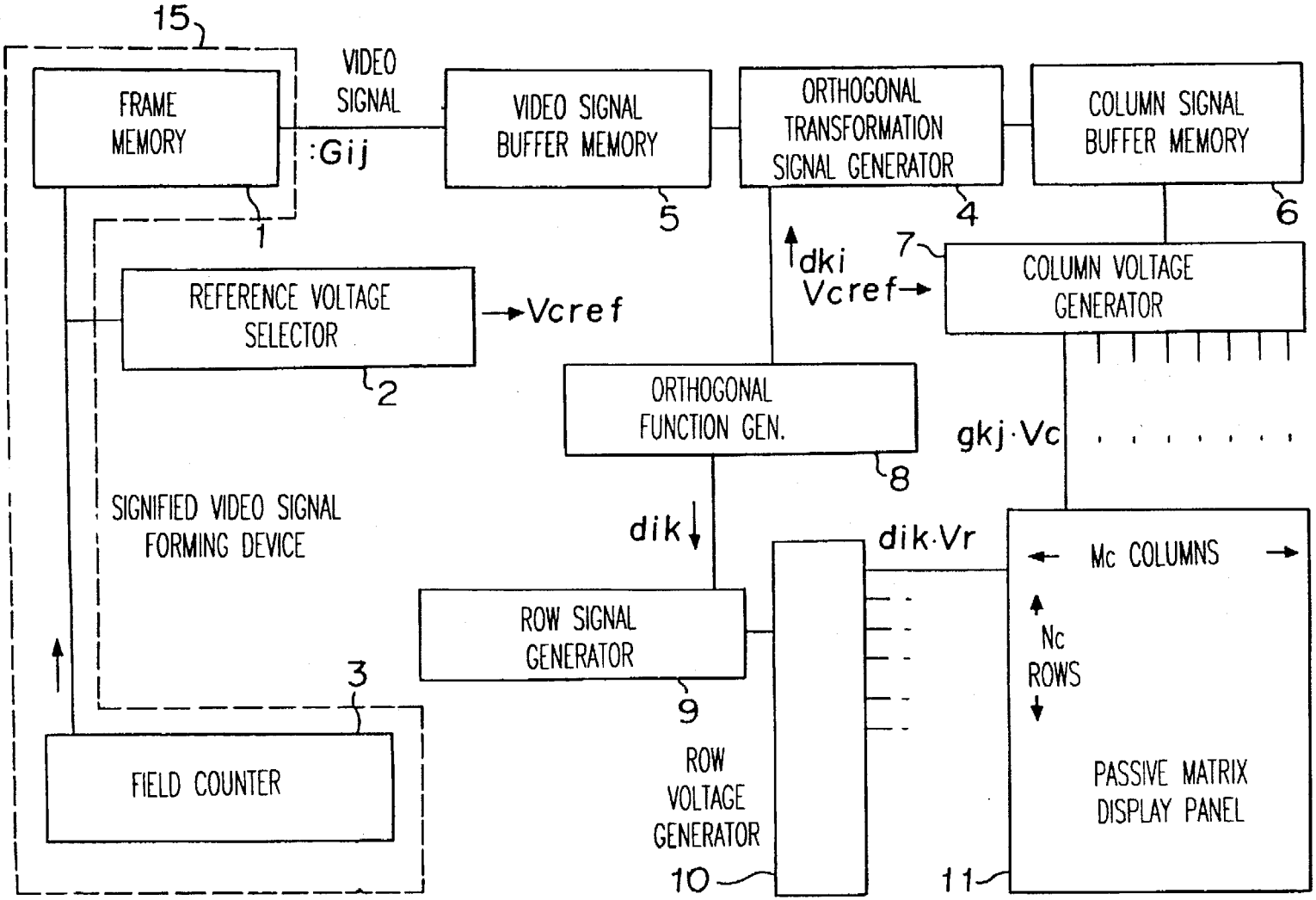
FIG. 1 is a block diagram for explaining the present invention.

FIG. 1 is a block diagram showing an example of the liquid crystal display apparatus of the present invention. The liquid crystal display apparatus in FIG. 1 comprises in addition to the construction shown in FIG. 2, a field counter 3 and a reference voltage selector 2 in which simultaneous selection of a plurality of row electrodes and an orthogonal function transformation of signals are used; a field picture is assigned for each bit of a video signal, and a column voltage peak value is changed in response to a bit significance, whereby a gray shade display becomes possible. In this embodiment, the frame memory 1 and the field counter 3 form a signified video signal forming device 15. Video signals from the frame memory 1 are taken in accordance with field numbers and address data. The video signals with significance values are determined by the field numbers and are supplied to a video signal buffer memory 5.

As a method of assigning a field for each bit significance, reference voltages for the row voltage and the column voltage may be simultaneously changed other than the above-mentioned method for signifying the reference for the column voltage. Or, a method of signifying only the reference for the row voltage may be used. When the row voltage and the column voltage are simultaneously changed, the peak values of the row and column voltages can be changed while keeping of the ON/OFF ratio to be the maximum.

For easiness of voltage control, use of the method changing only the column voltage is the best. Table 2 shows a change of the reference voltage with respect to a bit significance in cases that only the column voltage is changed; the column voltage and the row voltage are simultaneously changed, only the row voltage is changed, wherein the value of a bit having the most significance value is 1. As is clear from Table 2, when the column voltage and the row voltage are simultaneously changed, the width of control is narrow, and accordingly, a reference voltage source and a voltage dividing method having high precision and stability are necessary.

The column voltage and the row voltage are used by dividing the reference voltage. When a buffer amplifier for dividing the reference voltage is used, a supply voltage should be several volts larger than an output voltage. Accordingly, use of the method of the present invention with respect to the row voltage is disadvantageous in comparison with a case that the reference of the column voltage having a small peak voltage is changed.

TABLE 2

Relation of reference voltage to bit significance (w) of video signals
Time slot number per one field: F = 240
Ratio of the reference voltage for each field to the reference voltage of MSB field as 1

| Bit significance w | (MSB) 1 | ½ | ¼ | ⅛ | (LSB) 1/16 |
|---|---|---|---|---|---|
| A | 1 | .93649 | .90398 | .88752 | .87923 |
| B | 1 | .96870 | .95305 | .94523 | .94132 |

Figure 17:
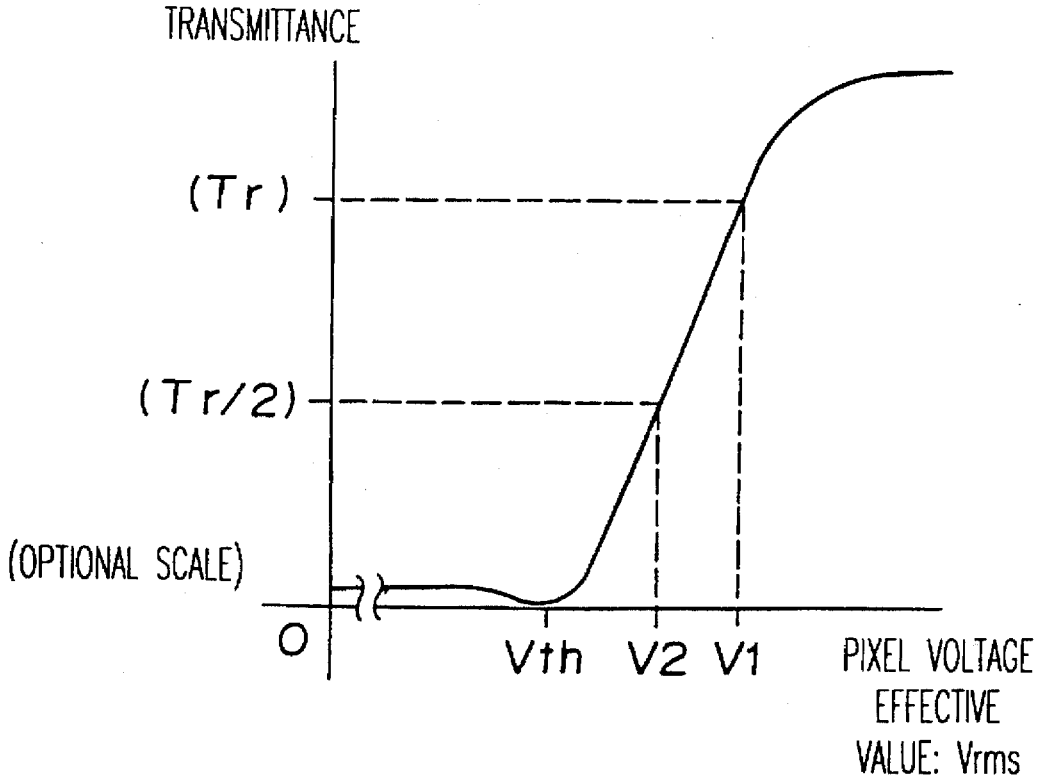
FIG. 17 is a graph showing a relation of the light transmittance and the effective value of a voltage applied to a pixel.

A: Reference voltage for column voltage or row voltage is changed
B: The ratio of row voltage to column voltage is fixed, and reference voltages for the both voltages are simultaneously changed On the other hand, in some case, a conventional STN type liquid crystal display apparatus has a voltage-transmittance characteristics as shown in FIG. 17. Namely, the transmittance of a pixel voltage at a point less than the point of the threshold voltage $V_{th}$ is larger than that of the threshold voltage $V_{th}$. In this case, if the column voltage and the row voltage are determined so that the $V_{ON}/V_{OFF}$ ratio is the maximum, the pixel voltage $V_{OFF}$ corresponding to "dark" is lower than that of the $V_{th}$ point whereby the contrast is reduced. Namely, a transmittance level larger than the $V_{th}$ point determines the limit to a low level side of the gray shade display.

In another embodiment of the present invention, $V_{OFF}$ assumes the smallest point of transmittance in any field whereby a further desirable gray shade display is obtained. In connection to this, a driving method to coincide $V_{OFF}$ with $V_{th}$, i.e., to obtain the smallest point of transmittance, will be described. Assuming that a constant bias voltage $V_{RO}$, which is not 0, is applied to row electrodes in a non-selection time although a row electrode bias voltage of $0_v$ is used in the above-mentioned explanation. The mean square value of pixel voltages ($V_{ij}$: effective value) is expressed by formula (29).

$$V_{ij}^2=\left[\sum_{k=1}^{L}\{(d_{ik}V_r-g_{kj}V_c)^2\}+\sum_{u=L+1}^{F}\{(V_{RO}-g_{uj}V_c)^2\}\right]/F \tag{29}$$

By developing and arranging formula (29), formula (30) is obtained.

$$V_{ij}^2 = \left[\sum_{k=1}^{L}\{(d_{ik}V_r)^2\}-2\sum_{k=1}^{L}\{d_{ik}g_{kj}\}V_rV_c+\sum_{u=1}^{F}\{(g_{uj}V_c)^2\}+(F-L)(V_{ro}^2)-2\sum_{u=L+1}^{F}\{g_{uj}\}V_{RO}V_c\right]/F \tag{30}$$

The signs of driving voltages with respect to a group of field data are arranged in an alternate form so as not to leave a direct current potential on the liquid crystal panel, which will be explained in examples described hereinafter. Accordingly, in formula (30), the sign of $V_{RO}$ is unchanged, and only the sign of the fifth term inclusive of the inversed sign of the driving voltage is changed. By having the sign, formula (30) is arranged as in formula (31).

$$V_{ij}^2 = \left[\sum_{k=1}^{L}\{(d_{ik}V_r)^2+\sum_{u=1}^{F}\{(g_{uj}V_c)^2\}-2\sum_{k=1}^{L}\{(d_{ik}g_{kj})\}V_rV_c+(F-L)V_{RO}^2\right]/F \tag{31}$$

In the method of the present invention, it is sufficient to consider only a case that the video signals have two values: bright and dark. Accordingly, the maximum value or the minimum value of formula (31) can be expressed by formula (32) in the same manner as formulas (18) and (19).

$$(V_{ij}^2)=L[V_r^2+Fq^2V_c^2\pm 2q|V_rV_c|+(M-1)V_{RO}^2]/F \tag{32}$$

Description will be made as to a case that the driving voltage peak value for each field is determined under the condition that the column electrode peak value and the row electrode peak value are simultaneously changed. When the driving voltage peak value is multiplied by k (k is the reduction rate of driving voltage wherein 0<k<1) while keeping the peak voltage ratio to be the same value, i.e., keeping the relation of formula (21), formula (33) is obtained from formula (32) in consideration of the formula (24) in the same manner as formulas (18) and (19).

$$(V_{ij}^2)=L\{k^2[V_r^2+Fq^2V_c^2\pm 2q|V_rV_c|]+[(M-1)V_{RO}^2]\}/F \tag{33}$$

Giving $V_{RO}$, the minimum value and the maximum value of formula (33) are expressed by formula (34).

$$(V_{ij}^2)_{MIN}=L\{k^2[V_r^2+Fq^2V_c^2-2q|V_rV_c|]+[(M-1)V_{RO}^2]\}/F$$
$$(V_{ij}^2)_{MAX}=L\{k^2[V_r^2+Fq^2V_c^2+2q|V_rV_c|]+[(M-1)V_{RO}^2]\}/F \tag{34}$$

When a video signal of a pixel (i, j) has a binary digit having an N bit length, formula (35) is provided.

$$G_{ij}=\{d1_{ij}, d2_{ij}, d3_{ij}, \ldots dN_{ij}\} \quad (35)$$

where a figure having a smaller suffix number means a bit having a larger significance value. With respect to a bit ($dN_{ij}$), a pixel voltage corresponding to "bright" is determined as $V_N$. Further, since the pixel voltage corresponding to "dark" is $V_{th}$, formula (36) is obtainable in correspondence with formula (34).

$$(V_{th}^2)=L\{k_N^2[V_r^2+Fq^2V_c^2-2q|V_rV_c|]+[(M-1)V_{RN}^2]\}/F$$

$$(V_N^2)=L\{k_N^2[V_r^2+Fq^2V_c^2+2q|V_rV_c|]+[(M-1)V_{RN}^2]\}/F \quad (36)$$

In formula (36), $V_{RN}$ is a non-selection voltage of an N bit subfield, and $K_N$ is the driving voltage reduction rate of the N bit subfield. In the field of a bit having the most significance value ($d1_{ij}$), $K_N=1$ and $V_{RN}=0$. In this case, the driving voltages $V_r$ and $V_c$ determined to satisfy formulas (21) through (24) are directly used. $V_{th}$ in formula (24) is the threshold value shown in FIG. 17, and $V_1$ in FIG. 17 corresponds to ($V_{ijMAX}$) in formula (19). When $V_{th}$ is provided, $V_1$ can be determined. Accordingly, $V_{ijMAX}$ is expressed by $V_{MAX}$. For the bit ($d1_{ij}$), formula (36) is as follows.

$$(V_{th}^2)=L\{V_r^2+Fq^2V_c^2-2q|V_rV_c|]\}/F$$

$$(V_1^2)=L\{V_r^2+Fq^2V_c^2+2q|V_rV_c|]\}/F$$

When formula (36) is rewritten by using the above formulas, formula (37) is obtained.

$$(V_{th}^2)=K_N^2V_{th}^2+L(M-1)V_{RN}^2/F$$

$$(V_N^2)=K_N^2V_{MAX}^2+L(M-1)V_{RN}^2/F \quad (37)$$

By solving formulas (37) to obtain ($K_N$) and ($V_{RN}$), formulas (38) are provided.

$$(K_N)^2=(V_N^2-V_{th}^2)/(V_{MAX}^2-V_{th}^2)$$

$$(V_{RN})^2=V_{th}^2M((V_{MAX}^2-V_N^2)/(M-1) \quad (38)$$

In formula (38), a driving condition is determined by the determination of $V_N$. Accordingly, for instance, since the significance value of a bit ($d2_{ij}$) is half the significance value of the bit ($d1_{ij}$), a pixel voltage effective value $V_2$ which has a half transmittance as $V_1$ is obtained from the characteristic curve in FIG. 17. Then, a driving voltage reduction rate ($K_2$) and a bias voltage $V_{R2}$ are calculated by using $V_2$ and formula (38). Similarly, column voltage peak values corresponding to a bit ($d3_{ij}$) and the other bits can be determined.

Figure 13:
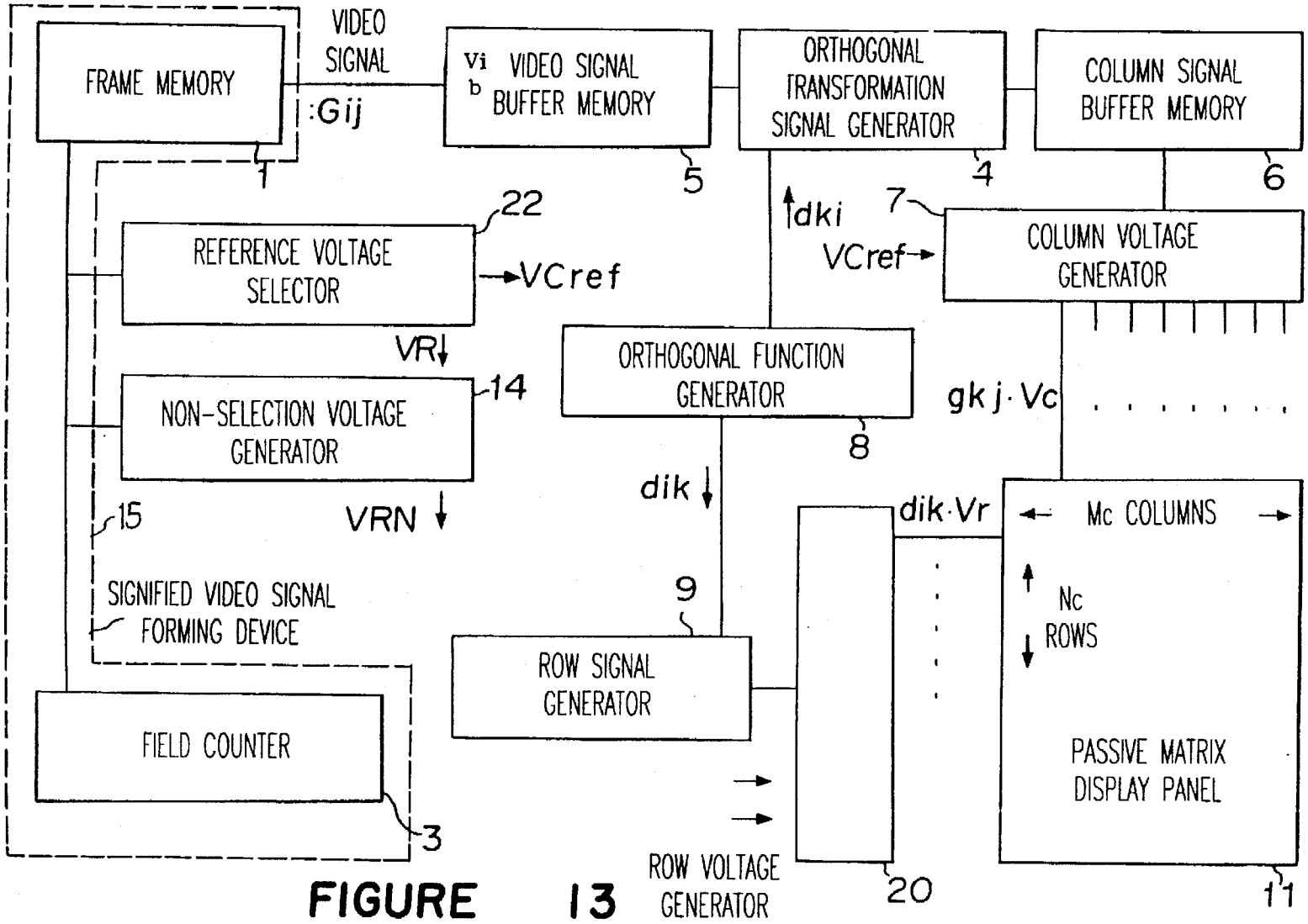
FIG. 13 is a block diagram for explaining another embodiment of the present invention.

FIG. 13 is a block diagram showing another embodiment of the liquid crystal display apparatus of the present invention wherein the same reference numerals designate the same parts.

The liquid crystal display apparatus shown in FIG. 13 comprises in addition to the construction shown in FIG. 2, the field counter 3, a reference voltage selector 22 and a non-selection voltage generator 14 wherein simultaneous selection of a plurality of row electrodes and the transformation of signals by an orthogonal function are used; a field picture (subpicture) is assigned for each bit, and driving voltage reference values for the row electrodes and column electrodes are changed in response to the significance values of bits to thereby effect a gray shade display. In this embodiment, the frame memory 1 and the field counter 3 form the signified video signal forming device 15.

Video signals from the frame memory 1 are taken in accordance with field numbers and address data. The video signals are those having significance values wherein the bit significance is determined by the field numbers. The signified video signals are supplied to the video signal buffer memory 5.

Besides the above-mentioned method for field displaying for each bit significance, either one of the reference voltages for the row voltage and the column voltage may be fixed and the other reference voltage may be changed.

In accordance with the method for the display apparatus shown in FIG. 1, the driving voltage peak value for a display panel can be reduced in comparison with a conventional technique. Further, since the column electrode driving reference voltage for a field picture is changed in response to a significance value of a video signal and a field picture is synthesized by a plurality of fields, a gray shade display can be realized by the least number of fields, and a flicker can be minimized. Further, since no correction signal is required, the performance vs cost ratio can be increased.

In accordance with the method for the apparatus shown in FIG. 13, the driving voltage peak value for a display panel can be reduced in comparison with a conventional technique. Further, in order to effect a gray shade display, the driving reference voltages of the row electrodes and the column electrodes of a field picture are changed in response to significance values of video signals, and at the same time, bias voltages are applied to non-selection electrodes. Accordingly, the gray shade display wherein a picture is synthesized by a plurality of fields can be realized by the least number of fields. Further, since a "dark" level is made in coincidence with the threshold value in any field, a large contrast ratio is obtainable and a flicker can be minimized. Further, since no correction signal is required, the performance vs cost ratio can be increased.

In the following, several Examples of the present invention will be described. However, the present invention should not be limited to the Examples.

EXAMPLE 1

Figure 3:
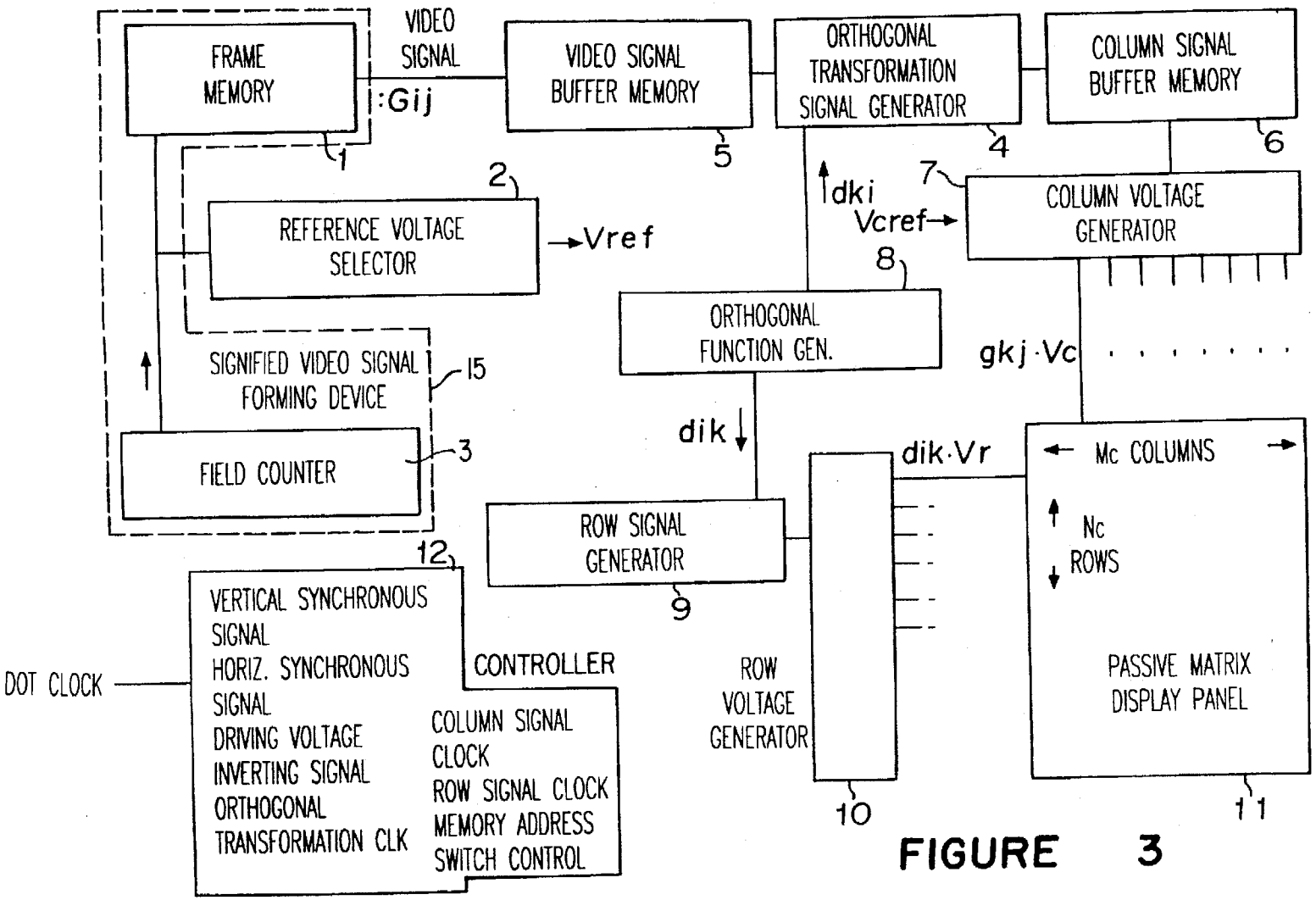
FIG. 3 is a block diagram showing the construction of the display apparatus according to an embodiment of the present invention.

A display apparatus shown in FIG. 3 was formed by preparing a liquid crystal display panel comprising 240 of row electrodes and 320×3=960 of column electrodes, and by determining the number of simultaneous selection of row electrodes being 8. Although the panel is constituted by 320 of pixels per row with respect to an image, 960 of column electrodes are necessary in order to divide light into primary colors of R, G and B in display.

The display apparatus in FIG. 3 comprises a frame memory 1, a reference voltage selector 2, a field counter 3, an orthogonal transformation signal generator 4, a video signal buffer memory 5, a column signal buffer memory 6, a column voltage generator 7, an orthogonal function generator 8, a row signal generator 9, a row voltage generator 10, a controller 12 and a display panel 11. The average response time of the display panel used was 50 ms, and the threshold voltage was 2.5 Vrms.

Figure 9:
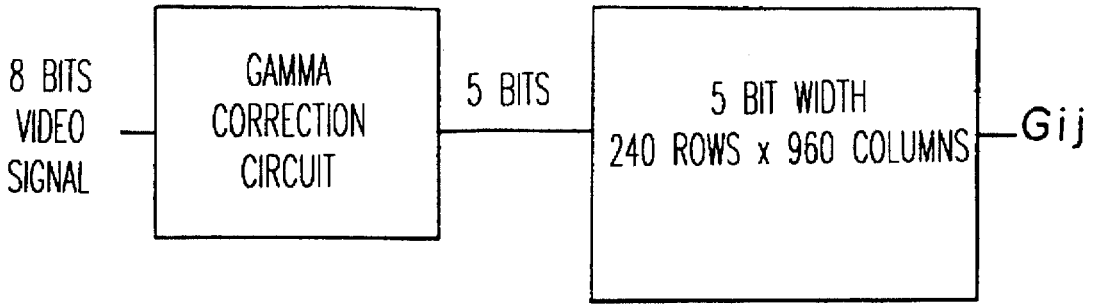
FIG. 9 is a block diagram showing the construction of an embodiment of a frame memory 1.
Figure 10:
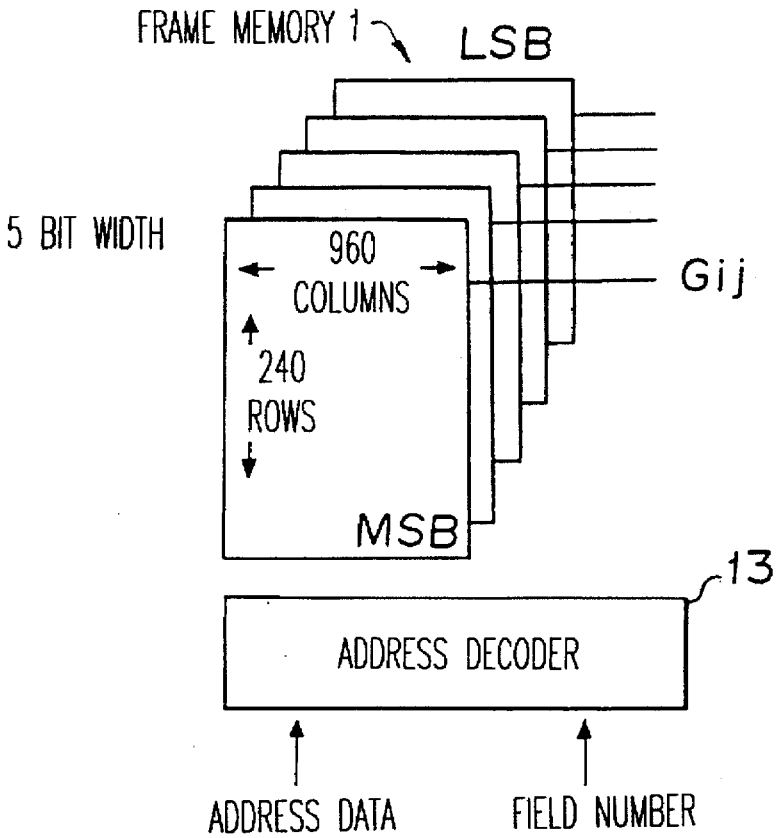
FIG. 10 is a block diagram showing the construction of another embodiment of the frame memory 1.
Figure 11:
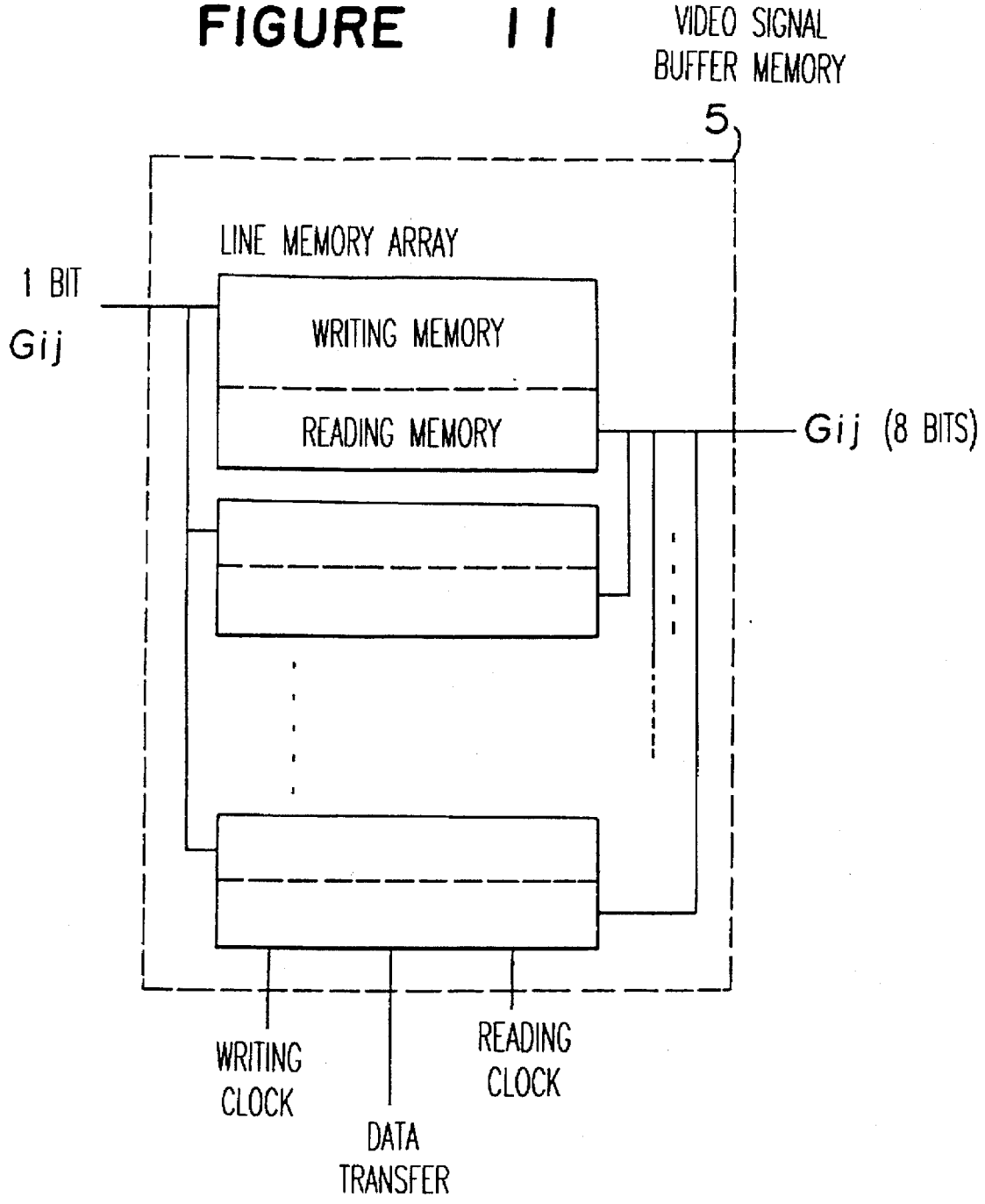
FIG. 11 is a block diagram showing the construction of an embodiment of a video signal buffer memory 5.

The frame memory 1 has a construction of 240 rows×960 columns×5 bits as shown in a block diagram in FIG. 10. The frame memory 1 stores each signal of R, G and B in the order of R, G and B in correspondence to each horizontal line, each of the signals being subjected to analogue-to-digital conversion and gamma correction. In this example, the data length of a brightness signal (a gray shade signal) for each pixel is 5 bits, and accordingly, the memory 1 is formed of a 5 bit length. However, when an input signal has an 8 bit length, a construction as shown in FIG. 9 wherein a 8/5 bit conversion system is included in a gamma correction circuit may be used.

The peak value $V_r$ of a row electrode driving voltage used was ±10.0 V and the peak value $V_c$ of a column electrode driving voltage of ±5.164V was used for the most significant bit (MSB) of a video signal. The column voltage peak values of other bits are set as shown in Table 3.

TABLE 3

Relation of column driving reference voltage ($\pm V_{cref}$) to bit significance of video signal
The number of time slots per one field: F = 240

| Bit significance w | (MSB) 1 | ½ | ¼ | ⅛ | 1/16 |
|---|---|---|---|---|---|
| $\lvert V_{cref}\rvert$ / MSB ratio | 5.1640<br>1 | 4.8360<br>.93649 | 4.6682<br>.90398 | 4.5832<br>.88752 | 4.5403<br>.87923 |

The column electrodes are arranged in the order of R, G and B as primary colors, each comprising 320, and 960 in total. Groups each consisting of 8 row electrodes are simultaneously selected from the upper portion of the display panel for each of the thirtieth horizontal line, and signals are transferred from the MSB region of the memory of the corresponding horizontal line to the buffer memory 5. The buffer memory 5 has 8 line memories so that a signal having an 8 bit length is outputted from the top of the lines in parallel. The outputted signal is called as a field signal $G_{ij}$. A single line memory has a double structure wherein two serial memories for writing and reading, each comprising 1×960 bits, are operated by respective clock pulses. Signals between the writing and the reading are transferred as a batch by means of data transferring signals. The field counter 3 is a 2 bit upcounter which supplies field numbers to an address decoder 13 in the frame memory 1 to determine a video signal having a bit significance to be taken. The field signal of a 8 bit length is inputted to the orthogonal transformation signal generator 4.

The orthogonal transformation signal generator 4 is so adapted to form a complement for the field video signals $G_{ij}$ through an inverter 42, the signals being inputted to an exclusive OR gate 43. The exclusive OR gate 43 also receives signals $d_{ki}$ from the orthogonal function generator 8 and outputs ($+d_{ki}$) or ($-d_{ki}$) in accordance with function values shown in Table 1. The calculation of ($d_{ki} \cdot G_{ij}$) is done in the inverter 42 and the exclusive OR gate 43. The outputs from the exclusive OR gate 43 are accumulated with respect to the simultaneously selected row numbers (i=1 through L) by an accumulator 41.

An inverter 44 is so adapted to send carriage control signals to an accumulator 41 when the value of the orthogonal function is (−1). The orthogonal transformation signal generator 4 comprises 8 blocks which correspond to the time slot number in a simultaneous selection time wherein one block is formed of the accumulator 41 through the inverter 44. The adding operations are treated in parallel for each time slot number k. "Time slot" is referred to as the minimum pulse width of the orthogonal function used as driving signals for the row electrodes, and expressed as $\Delta t_k$.

Figure 6:
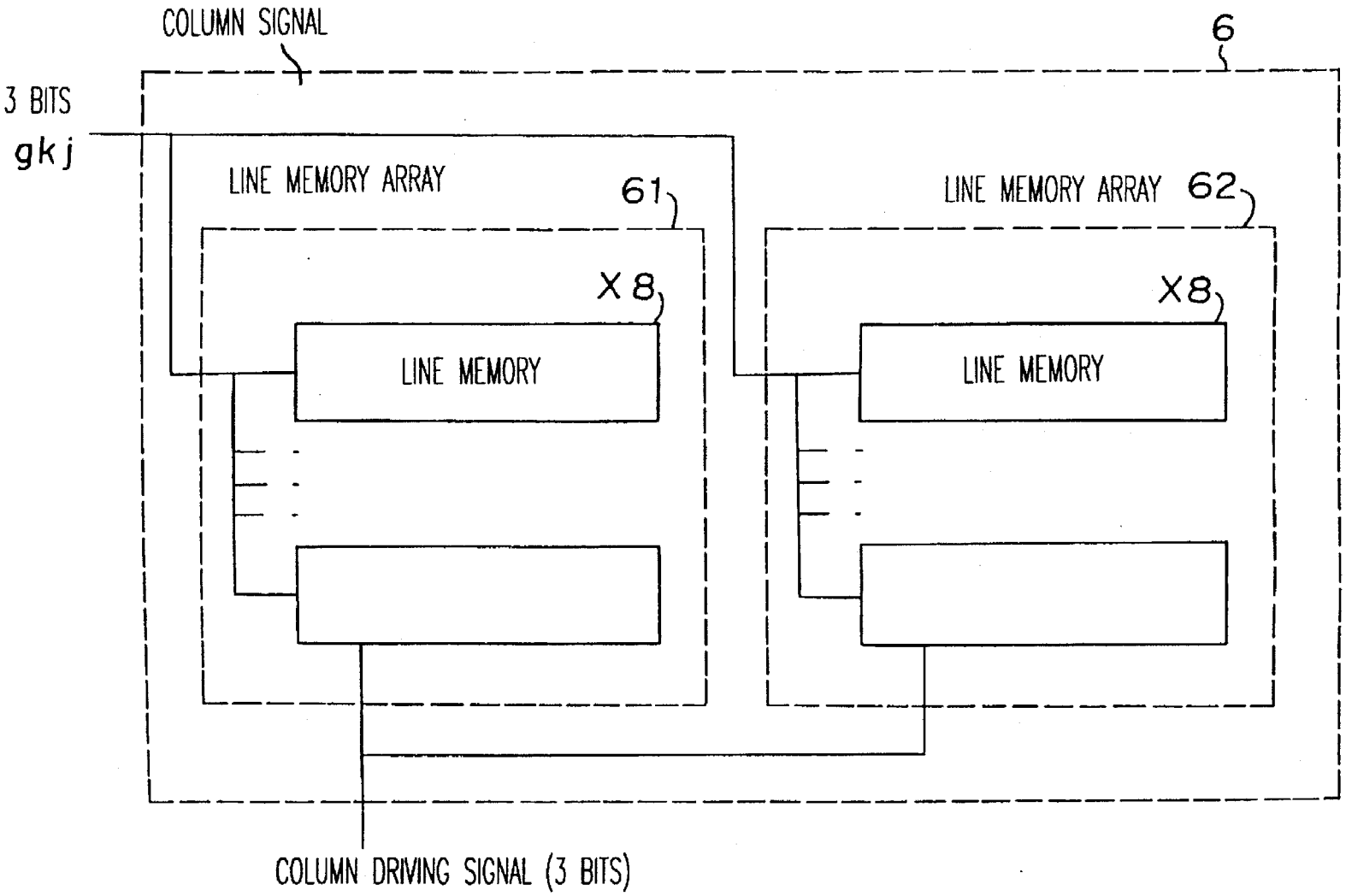
FIG. 6 is a block diagram showing the construction of an embodiment of a column signal generator 6.

As shown in FIG. 6, the column signal buffer memory 6 comprises two sets of line memory arrays wherein each memory array comprise 8 line memories. The construction of the line memories used is the same as the line memories of the video signal buffer provided except that the bit length is 3 bits. The output $g_{kj}$ of the accumulator 41 has a 3 bit length, which is stored in line memories corresponding to the time slot number k in a line memory array 61 or 62 in the next column signal generator 6.

As described before, the orthogonal transformation signals of the pixels (i, j) (:i=1 through 8, j=1 through 960) are accumulated and added in parallel in 8 accumulators, and operations of orthogonal transformation and adding are executed for the simultaneously selected rows. The accumulated and added signals are stored in the line memories, and then, the operation of conversion of the video signals for the next columns is started. The operation of conversion is conducted for all simultaneously selected columns in the same manner as above, and when signals for one field are stored in the eight line memories, signals are supplied from line memories having earlier orthogonal transformation number to the column voltage generator 7. The orthogonal transformation number k is 1 through 8.

The orthogonal function generator 8 produces function values shown in Table 1, which are supplied as signals of ($d_{ki}$) or ($d_{ik}$) to the orthogonal transformation signal generator 4 and the row signal generator 9. The signals inputted to the orthogonal transformation signal generator 4 are supplied at a number of k in parallel in the order of the row number i. The timing of inputting the signals corresponds to the timing of operating the video signals. The row signal generator 9 receives the function values from the orthogonal function generator 8 to thereby form signals of a row driving pattern and a simultaneous selection pattern for each time slot, the signals being supplied to the row voltage generator 10.

Figure 8:
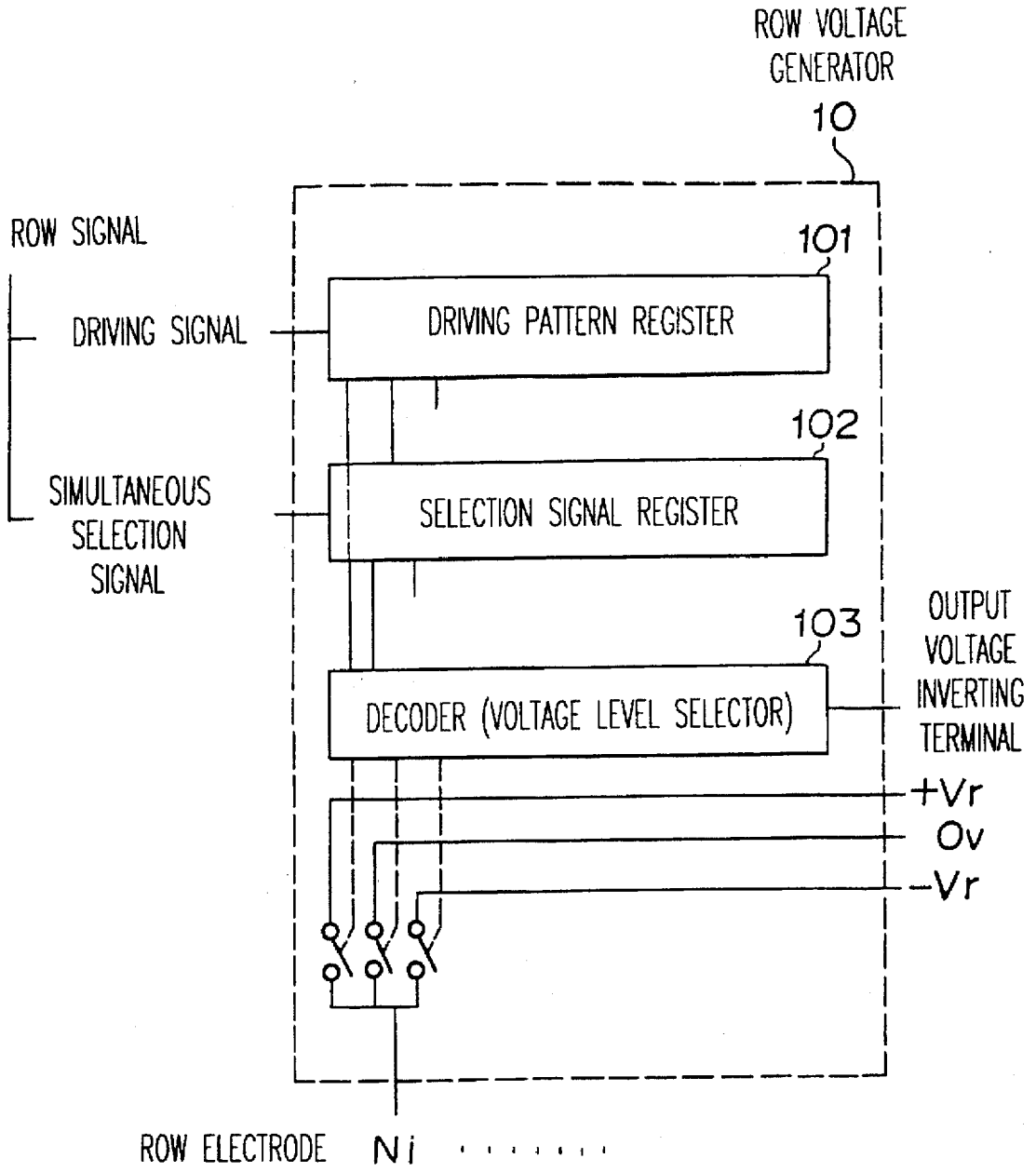
FIG. 8 is a block diagram showing the construction of an embodiment of a row voltage generator 10.

The row voltage generator 10 has a construction as shown in FIG. 8 wherein it comprises a driving pattern register (shift register) 101, a selection signal register (shift register) 102 and a decoder (voltage level selector) 103. As the decoder 103, a multiplexer is used. Simultaneous selection rows are determined depending on information in the selection signal register 102. Further, information in the driving pattern register 101 determines whether each of the rows outputs ($+V_r$) or ($-V_r$). A non-selection row outputs 0V. These values are relative values.

Figure 7:
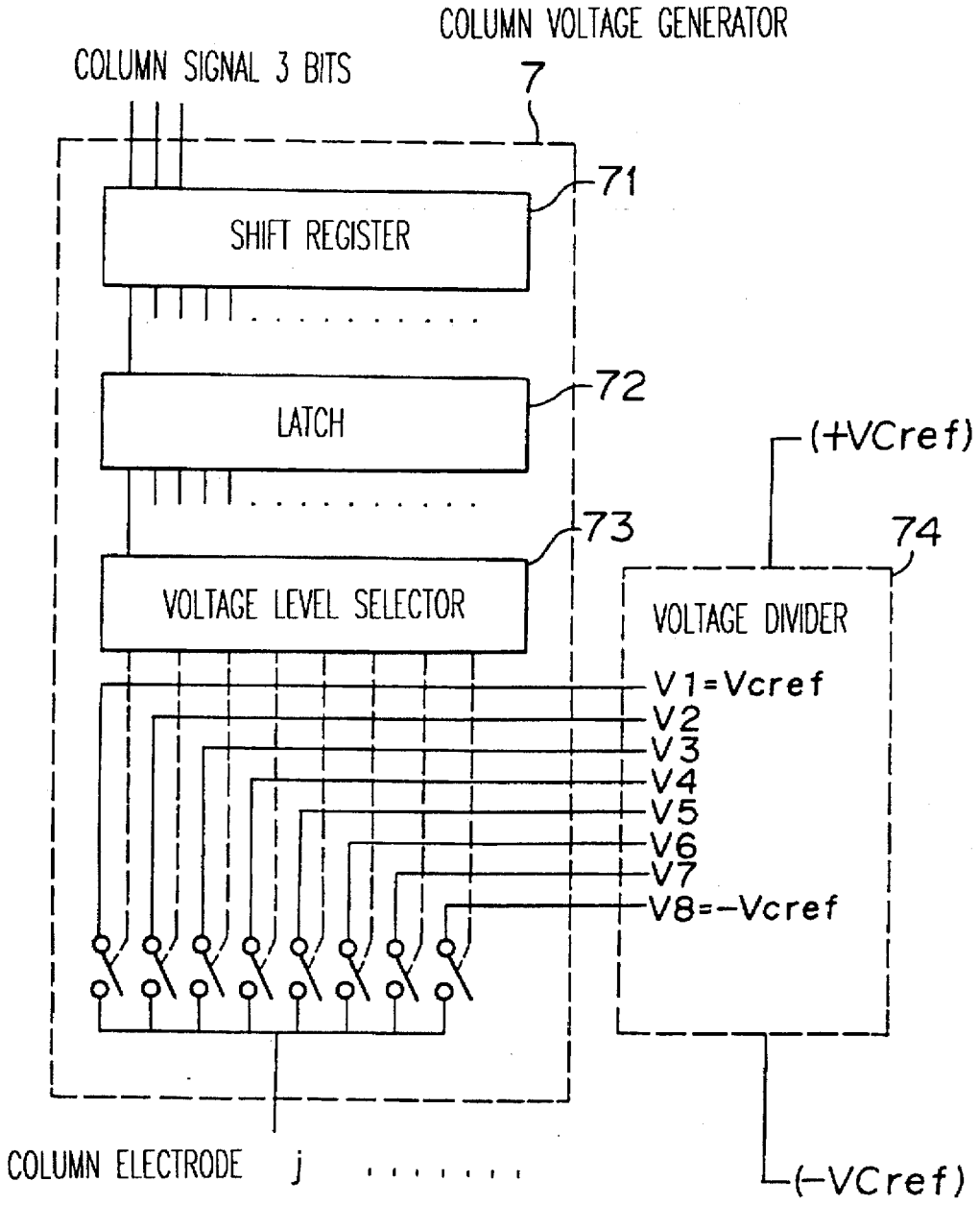
FIG. 7 is a block diagram showing the construction of an embodiment of a column voltage generator 7.

As shown in FIG. 7, the column voltage generator 7 comprises a shift register 71, a latch 72, a voltage level selector 73 and a voltage divider 74. As the voltage level selector 73, a multiplexer is used. The column voltage generator 7 also conducts the conversion of the column voltage and the conversion of the orthogonal function corresponding to the orthogonal transformation number to the row voltage simultaneously when data for one row are supplied to the shift register 71.

The sign of the driving voltage for a group of field data is inversed and the same signals are used for driving again. Namely, the inverted output terminals of the column voltage generator 7 and the row voltage generator 10 are kept active while the signals for the previous field are repeated, whereby the driving waveform having the opposite sign to that of the previous field can be obtained. The reason why such a driving sequence is used is because a direct current potential should not be left on the liquid crystal panel. While one field is displayed, a display for the next field is prepared. For this purpose, an additional set of line memory array is prepared as shown in FIG. 6 so that the operations and the storing of data are conducted in the same manner as above for the next field number. The two line memories perform successively signal conversion to the fifth field.

Figure 5:
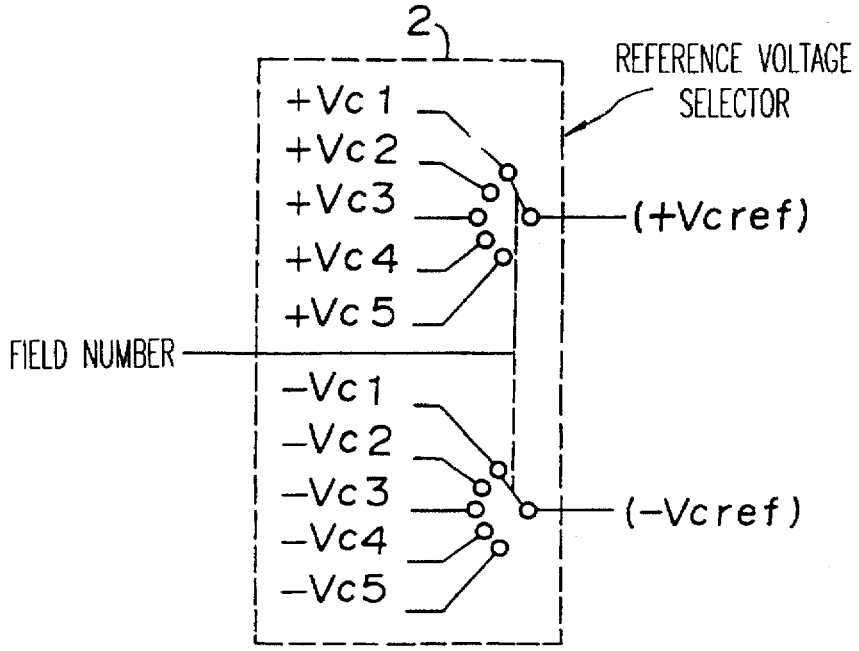
FIG. 5 is a block diagram showing the construction of an embodiment of a reference voltage selector 2.

The reference voltage selector 2 has a construction as shown in FIG. 5 wherein reference voltages are outputted to the column voltage generating device 7 in a relation as shown in Table 3 by signals from the field counter 3, i.e. depending on the bit significance of signals to be displayed. In this case, the peak value of the column voltage is made equal to the absolute value of the reference voltages to be applied.

The frame frequency which provided an excellent display in accordance with the method described above was 30–40 Hz.

A time T required for one frame was as follows.

$$T=2(5F')\Delta t_k=25\text{–}35 \text{ ms}$$

$$(F'=F+8=248,\ \Delta t_k=10\text{–}14\ \mu s)$$

In a high frame frequency region, it was difficult to conduct operations of signals. On the other hand, in a low frequency region, a flicker became conspicuous. The reason why time slots of an F' was used in place of the time slot number F, is to use a vertical interval of ($8\Delta t_k$). A settling time is required to switching the reference voltage. However, the reference voltage could be within ±15 mV of a target voltage in the vertical interval.

In the construction shown in FIG. 3, the column electrodes are divided into 6 groups each comprising 160 column electrodes, and a signal treatment was conducted in parallel so that a signal treating system from the frame memories to the column electrode generator corresponds to the column electrode group. As a result, a range of frame frequency could be broadened.

EXAMPLE 2

Figure 14:
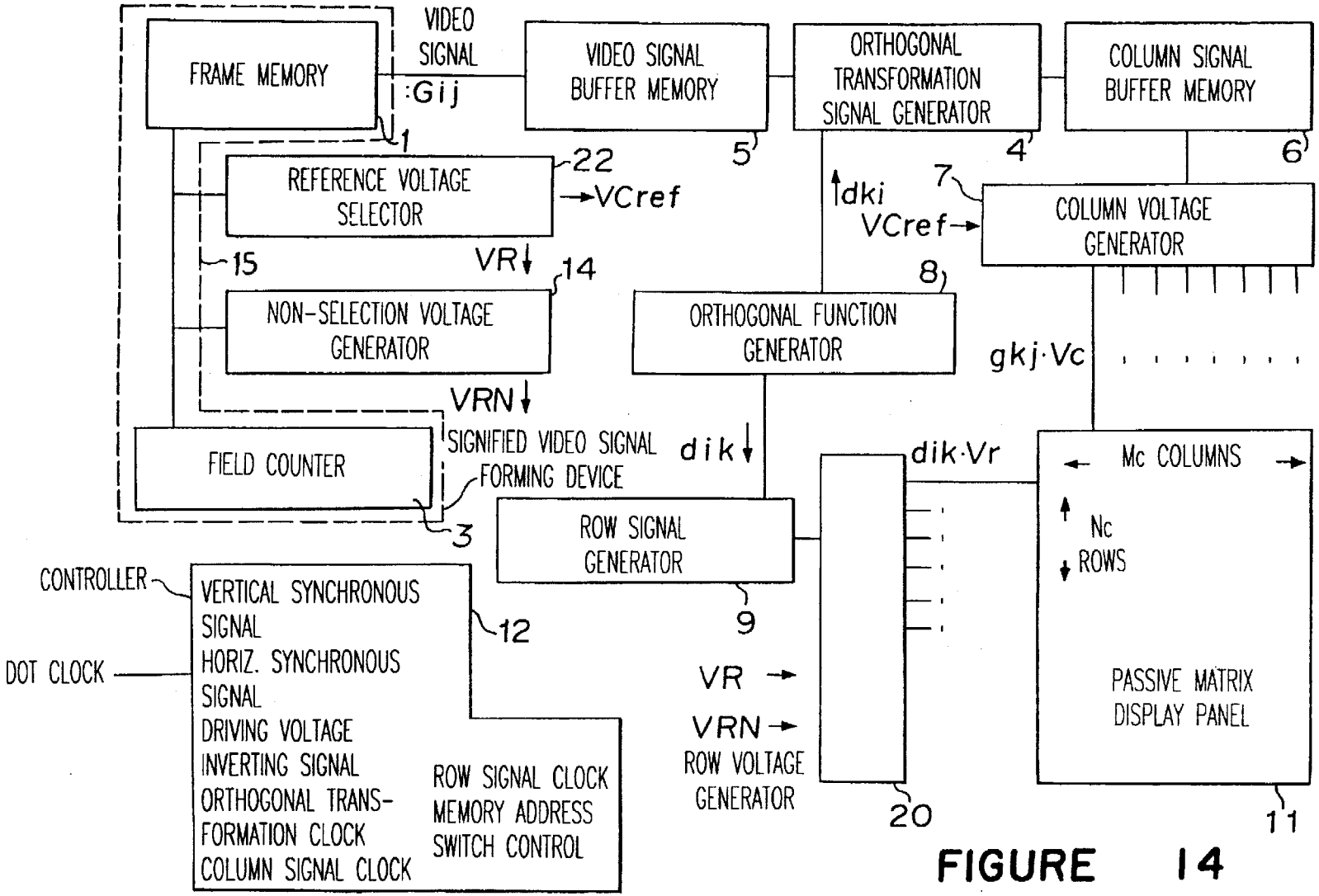
FIG. 14 is a block diagram showing the construction of another embodiment of the present invention.
Figure 16:
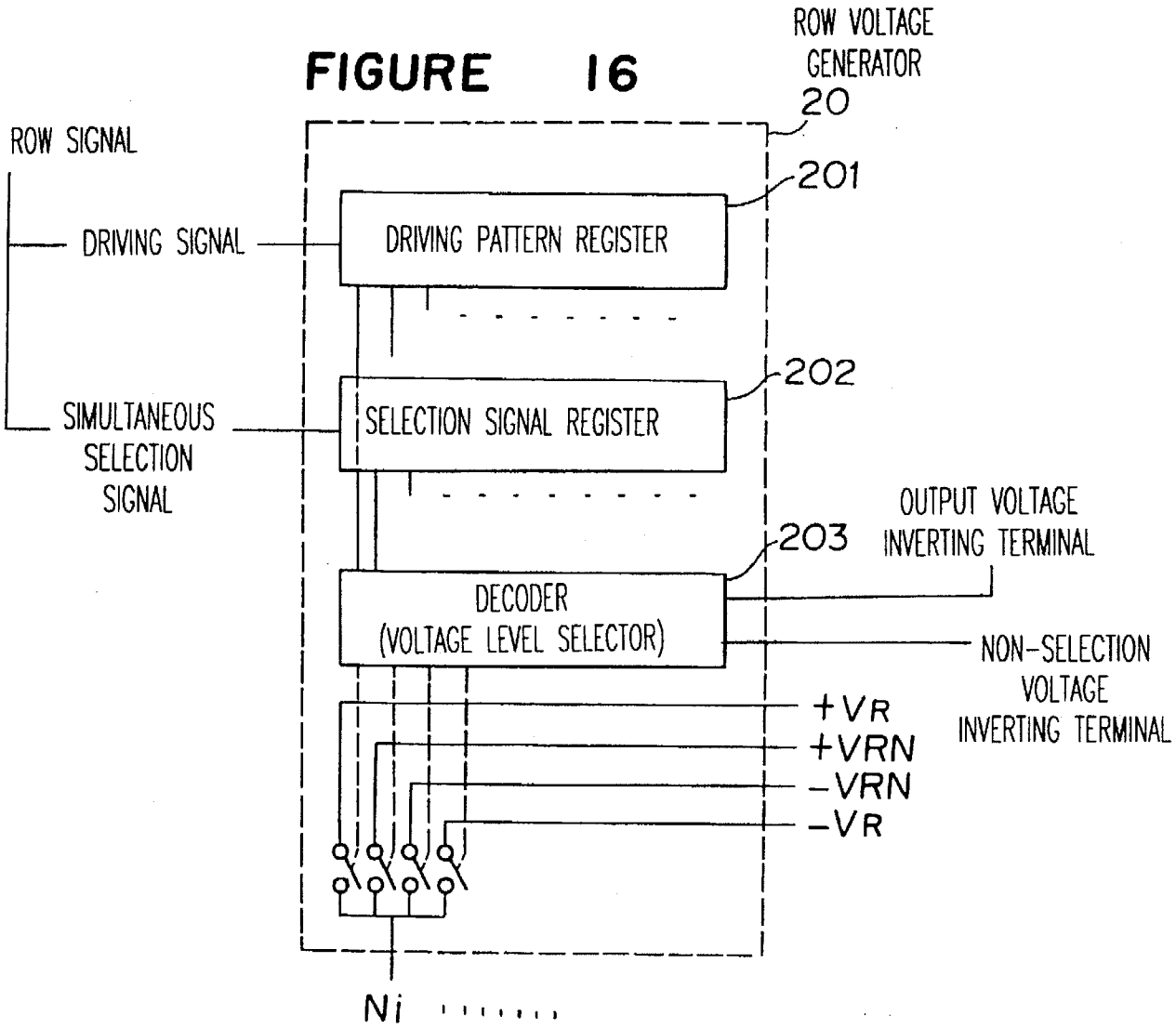
FIG. 16 is a block diagram showing the construction of another embodiment of the row voltage generating device 10.

A display apparatus shown in FIG. 14 was formed by preparing a liquid crystal display panel comprising 240 of row electrodes and 320×3=960 of column electrodes, and by determining the number of simultaneously selected row electrodes being 8. The liquid crystal display panel had characteristics as shown in FIG. 16. The average response time of the display panel used was 50 ms and the threshold voltage was 2.5 $V_{rms}$. Although the panel is constituted by 320 of pixels per row with respect to an image, 960 of column electrodes are necessary in order to divide light into primary colors of R, G and B in display. The display apparatus shown in FIG. 14 comprises a frame memory 1, a reference voltage selector 22, a field counter 3, an orthogonal transformation signal generator 4, a video signal buffer memory 5, a column signal buffer memory 6, a column voltage generator 7, an orthogonal function generator 8, a row signal generator 9, a row voltage generator 20, a controller 12, a non-selection voltage generator 14 and a display panel 11, which are similar to those used in Example 1.

The construction of the frame memory 1 is the same as that in Example 1 and shown in FIG. 10. The peak value $V_r$ of a row electrode driving voltage used was ±10.0 V with respect to the most significant bit (MSB) of the video signals, and the peak value $V_c$ of a column electrode driving voltage was ±5.164 V. In this case, a voltage for non-selection row electrodes was 0v. The row voltage peak values, the row electrode peak values and the non-selection row voltages for other bits were determined as shown in Table 4. In each bit, the selection voltage is $\pm V_R$.

TABLE 4

Relation of driving reference voltage ($\pm V_{cref}$, $\pm V_R$) and non-selection voltage ($V_{RN}$) to bit significance (w) of video signal Number of time slots per one field: F = 240

| Bit significance w | (MSB) 1 | ½ | ¼ | ⅛ | (LSB) 1/16 |
|---|---|---|---|---|---|
| $\lvert V_{cref}\rvert$ | 5.1640 | 3.6224 | 2.5511 | 1.8002 | 1.2716 |
| $\lvert V_R\rvert$ | 10.000 | 7.0148 | 4.9401 | 3.4861 | 2.4625 |
| $\lvert V_{RN}\rvert$ | 0.000 | 1.6828 | 2.0347 | 2.1934 | 2.2681 |

Figure 4:
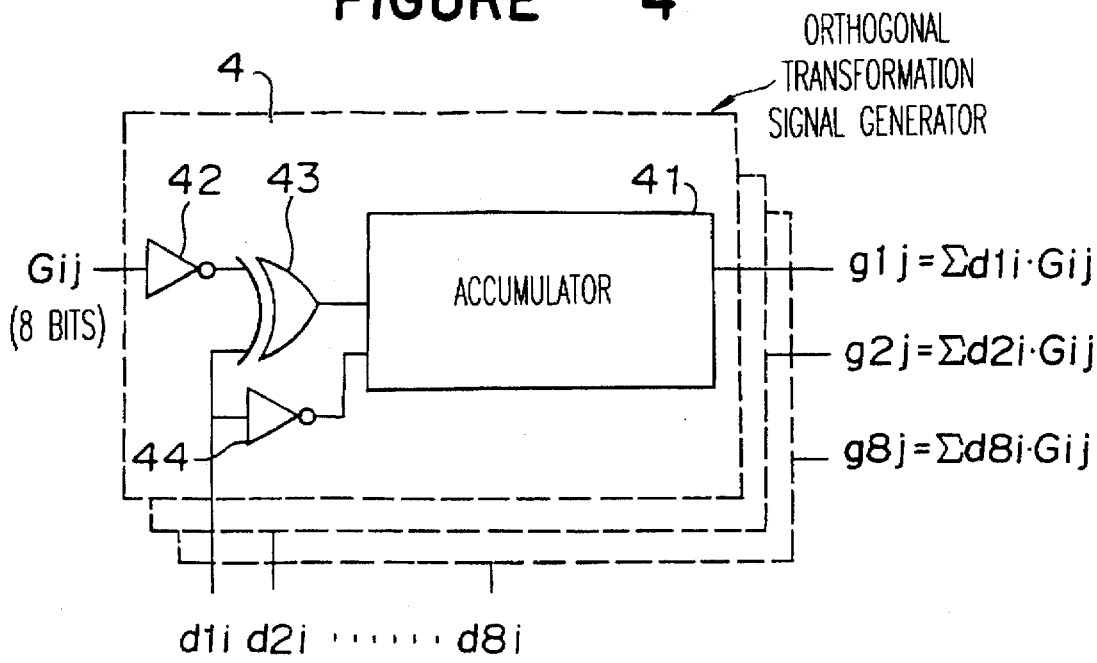
FIG. 4 is a block diagram showing the construction of an embodiment of an orthogonal transformation signal generator 4.

The construction of the field counter 3, the orthogonal transformation signal generator 4 (FIG. 4), the column signal buffer memory 6 (FIG. 6), the orthogonal function generator 8 and the row signal generator 9 are the same as those in Example 1.

A row voltage generating device 20 has a construction as shown in FIG. 16, which comprises a driving pattern register 201, a selection signal register 202 and a decoder (voltage level selector) 203. As the decoder 203, a multiplexer is used. Row electrodes to be simultaneously selected are determined depending on information in the selection signal register 202, and information in the driving pattern register 201 determines whether each row electrode selected outputs ($+V_r$) or ($-V_R$). For the non-selection row electrodes, ($+V_{RM}$) or ($-V_{RN}$) is outputted. In this case, the output is connected to the non-selection row electrodes depending on a level appearing at non-selection voltage inverting terminal connected to the decoder 203, and the output voltage is inverted for each scanning of the entire subfields. The above-mentioned values are relative values. Further, the column voltage generator 7 (FIG. 7) is the same as that in Example 1.

Figure 15:
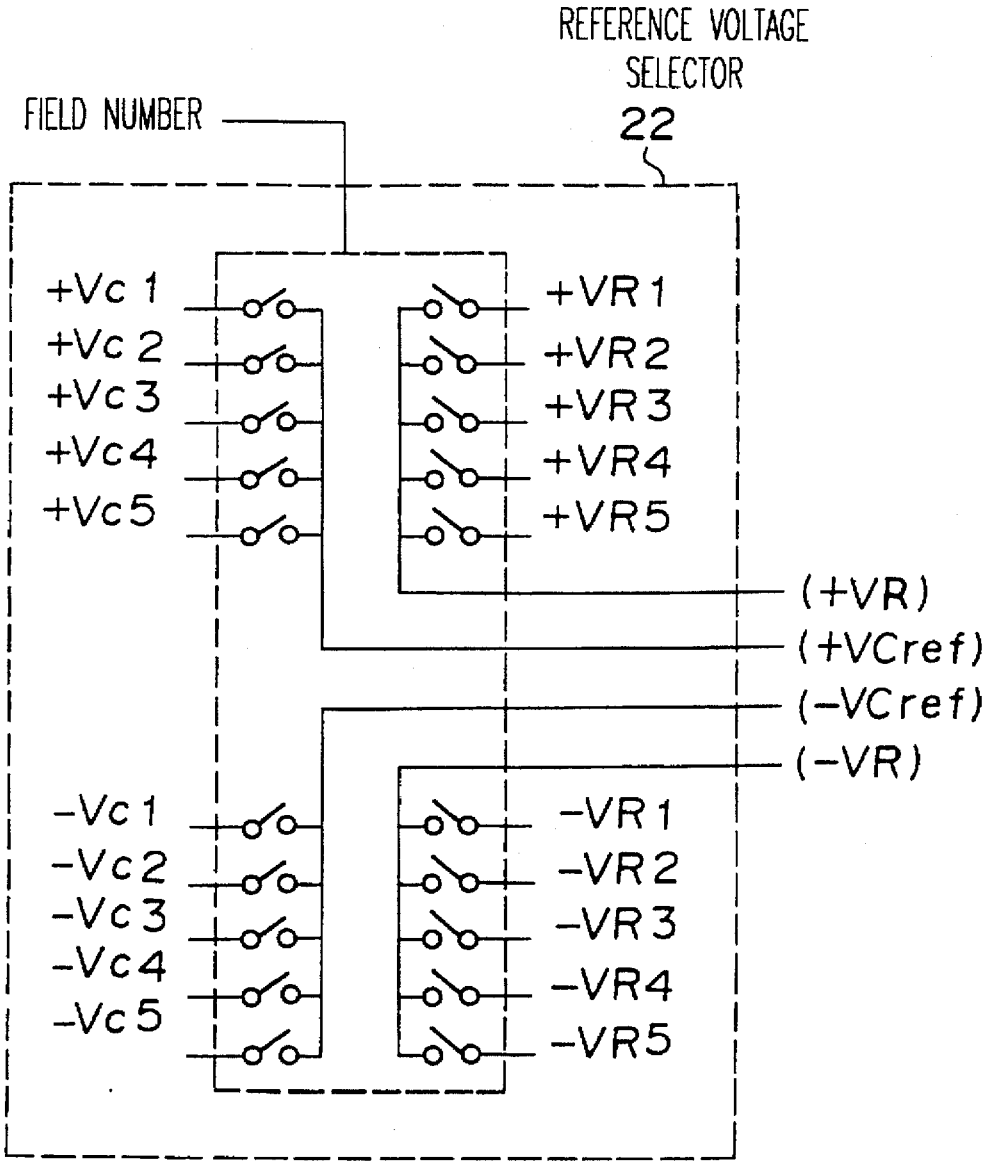
FIG. 15 is a block diagram showing the construction of another embodiment of the reference voltage selector 2.

The reference voltage selector 22 has a construction as shown in FIG. 15, which is adapted to output reference voltages to the column voltage generator 7 and the row voltage generator 10 in a relation as shown in Table 2 by signals from the field counter 3, i.e. depending on bit significance of signals to be displayed. In this example, the row voltage peak value and the column voltage peak value are made equal to the absolute value of the reference voltages to be applied.

The frame frequency having an excellent display used in the above-mentioned method was 30–40 Hz. A time T necessary for one frame was as follows.

$$T=2(5F')\Delta t_k=25\text{–}35 \text{ ms}$$

$$(F'=F+8=248,\ \Delta t_k=10\text{–}14\ \mu s)$$

The operation of the signals in a high frame frequency region, was difficult. Further, in a low frequency region, a flicker became conspicuous. The reason why a time slot number F' was used in place of the time slot number F was to use a vertical interval of ($8\Delta t_k$). Although a settling time is required to switch the above-mentioned standard voltages, they can be within ±15 mV of a target voltage in the vertical interval.

Further, in the same manner as Example 1, the column electrodes were divided into 6 groups each having 160 electrodes in the construction shown in FIG. 14, and a signal treatment was conducted in parallel so that a signal treating system from the frame memories to the column electrode generator corresponded to the column electrode group. As a result, a range of frame frequency could be broadened.

In accordance with the present invention, a row voltage driving of a display panel becomes possible; driving signals for a gray shade display can be generated with a simple construction, and a high frequency component and low frequency component can be reduced, whereby a display apparatus of an excellent quality and a low manufacturing cost and free from non-uniformity of display and a flicker, can be provided.

We claim:

1. A display apparatus for effecting a gray shade display in which a light transmittance of a pixel selected by a scanning electrode and a data electrode is changed in correspondence with a difference of voltages applied to the scanning electrode and the data electrode, comprising:

an input for receiving digital video signals having a predetermined number of bits;

a display panel having a plurality of scanning electrodes and a plurality of data electrodes;

a signified video signal forming device for forming signified video signals by distributing digital video signals in a picture to subpictures whose number is equal to the predetermined number of bits of the inputted digital video signals, each subpicture having a bit significance value directed to a number of gradation levels in the gray shade display;

an orthogonal function generator for generating orthogonal function signals having substantial orthogonality;

an orthogonal transformation signal generator for receiving the signified video signals and the orthogonal function signals to operate and output data signals;

a scanning voltage generator for receiving scanning signals to apply scanning voltages to the scanning electrodes of the display panel; and a data voltage generator for receiving data signals to apply data voltages to the data electrodes of the display panel, wherein the scanning voltage generator and the data voltage generator are such ones that a peak value of a driving voltage, in each of the subpictures, applied to the display panel as a voltage difference between the scanning voltage and the data voltage corresponds to the significance value of a respective bit of the digital video signals.

2. The display apparatus according to claim 1, wherein the signified video signal forming device comprises a field counter for outputting subpicture numbers, and a frame memory for receiving the digital video signals and the subpicture numbers to output the signified video signals.

3. The display apparatus according to claim 1, further comprising a non-selection voltage generator which receives a subpicture number to form a non-selection voltage so that an effective value of a driving voltage corresponding to a low level in a subpicture agrees with a predetermined voltage in spite of the significance value of the respective bit.

4. The display apparatus according to claim 3, wherein the predetermined voltage is a voltage such that light transmittance is substantially a minimum on a voltage light transmittance characteristic curve of the display panel.

5. The display apparatus according to claim 1, wherein the display apparatus is a liquid crystal display apparatus.

6. A driving method for effecting a gray shade display in a display apparatus in which a light transmittance of a pixel selected by a scanning electrode and a data electrode is changed in correspondence with a difference of voltages applied to the scanning electrode and the data electrode, and including a display panel having a plurality of scanning electrodes and a plurality of data electrodes, a signified video forming device for forming signified video signals by distributing digital video signals in a picture to subpictures having a same predetermined number of bits, each subpicture having a bit significance directed to a number of gradation levels in the gray shade display, comprising the steps of:

generating orthogonal function signals having substantial orthogonality;

receiving the signified video signals and the orthogonal function signals to operate and output data signals;

receiving scanning signals to apply scanning voltages to the scanning electrodes of the display panel; and receiving data signals to apply data voltages to the data electrodes of the display panel, wherein the scanning voltages and the data voltages are such ones that a peak value of a driving voltage, in each of the subpictures, applied to the display panel as a voltage difference between the scanning voltage and the data voltage corresponds to the significance value of a respective bit of the digital video signals.

7. The driving method for a display apparatus according to claim 6, wherein voltages applied to the scanning electrode and the data electrode are simultaneously changed with a constant rate in correspondence with the bit significance values corresponding to each of the subpictures.

8. The driving method for a display apparatus according to claim 6, wherein a reference voltage applied to either the data electrode or the scanning electrode is changed depending on the bit significance of each of the subpictures.

9. The driving method for a display apparatus according to claim 6, wherein the display panel is a liquid crystal display apparatus.

10. The driving method for a display apparatus according to claim 6, wherein an effective value of a driving voltage corresponding to a low level in a subpicture agrees with a predetermined voltage independent of a bit significance.

11. The driving method for a display apparatus according to claim 10, wherein the predetermined voltage is a voltage such that the light transmittance is substantially a minimum on a voltage-light transmittance characteristic curve of the display panel.

12. The driving method for a display apparatus according to claim 10, wherein a scanning voltage and a data voltage are produced from a common reference voltage source so as to maintain a condition that a ratio of a peak value of the scanning voltage to a peak value of the data voltage is constant; the scanning voltage and the data voltage are changed with a same rate depending on the significance values of the bits corresponding to each of the subpictures; and a predetermined bias voltage is applied to a scanning electrode in a non-selection state, whereby a desired gray shade level is obtained.

* * * * *